US012741803B2

(12) United States Patent
White et al.

(10) Patent No.: US 12,741,803 B2
(45) **Date of Patent: *Sep. 22, 2026**

(54) SYSTEM TO HOLD MULTIPLE BEVERAGE CONTAINERS

(71) Applicant: 2SURV, INC., Austin, TX (US)

(72) Inventors: Russell W. White, Austin, TX (US); Shawn A. Roberts, Temple, TX (US); Laura J. Roberts, Temple, TX (US)

(73) Assignee: 2SURV, INC., Austin, TX (US)

( * ) Notice: Subject to any disclaimer, the term of this patent is extended or adjusted under 35 U.S.C. 154(b) by 2 days.

This patent is subject to a terminal disclaimer.

(21) Appl. No.: 18/806,258

(22) Filed: Aug. 15, 2024

(65) Prior Publication Data

US 2024/0400290 A1 Dec. 5, 2024

Related U.S. Application Data

(63) Continuation-in-part of application No. 18/616,530, filed on Mar. 26, 2024, which is a (Continued)

(51) Int. Cl.
*B65D 81/38* (2006.01)
*B65D 25/14* (2006.01)
(Continued)

(52) U.S. Cl.
CPC ..... *B65D 81/3897* (2013.01); *B65D 25/14* (2013.01); *B65D 25/24* (2013.01);
(Continued)

(58) Field of Classification Search
CPC ..... B65D 81/3897; B65D 81/3888; B65D 81/3876; B65D 81/261; B65D 88/22;
(Continued)

(56) References Cited

U.S. PATENT DOCUMENTS 147,924 A 2/1874 Fink
1,019,416 A 3/1912 Bonnell
(Continued)

FOREIGN PATENT DOCUMENTS

CA 2412020 C 1/2007
CA 2463523 C 11/2008
(Continued)

OTHER PUBLICATIONS

English Language Translation of German Publication No. 102005035676, 16 pages total.
(Continued)

*Primary Examiner* — Robert J Hicks
(74) *Attorney, Agent, or Firm* — Trop, Pruner & Hu, P.C.

(57) ABSTRACT

A system for holding multiple beverage containers may include a cooler or carrier with toting handles, closing tabs, and base. The base may also include feet that hold the base a sufficient height from the ground. The base may have a drain hole located in the base. Extending up from the base may be a multi-layer soft-sided wall where different layers perform different desired functions. For example, an inside layer closest to the internal cavity may be a waterproof layer, a middle layer may be an insulating layer, and an external layer may be a decorative layer. Within the cooler or carrier may be one or more silos with a mating plug within the silo. The silo may be generally cylindrical in shape and configured to accept a beverage container in a manner that allows a beverage within the container to be accessed from outside the cooler.

20 Claims, 28 Drawing Sheets

Related U.S. Application Data continuation-in-part of application No. 18/456,746, filed on Aug. 28, 2023, now Pat. No. 12,280,937, which is a continuation of application No. 17/834,348, filed on Jun. 7, 2022, now Pat. No. 11,772,875, which is a continuation-in-part of application No. 16/943,057, filed on Jul. 30, 2020, now Pat. No. 11,401,102, which is a continuation of application No. 16/115,871, filed on Aug. 29, 2018, now Pat. No. 10,730,685.

(60) Provisional application No. 62/560,295, filed on Sep. 19, 2017.

(51) Int. Cl.

| | |
|---|---|
| ***B65D 25/24*** | (2006.01) |
| ***B65D 25/28*** | (2006.01) |
| ***B65D 25/38*** | (2006.01) |
| ***B65D 88/16*** | (2006.01) |
| ***F25D 3/08*** | (2006.01) |
| *F25D 21/14* | (2006.01) |

(52) U.S. Cl.

CPC ..... *B65D 25/2864* (2013.01); *B65D 25/38* (2013.01); *B65D 88/16* (2013.01); *F25D 3/08* (2013.01); *F25D 21/14* (2013.01); *F25D 2303/081* (2013.01); *F25D 2331/801* (2013.01); *F25D 2331/803* (2013.01); *F25D 2331/805* (2013.01); *F25D 2331/809* (2013.01)

(58) Field of Classification Search

CPC ..... B65D 88/16; B65D 90/24; B65D 25/14; B65D 25/24; B65D 25/2864; B65D 25/38; B65D 25/22; F16N 31/004; F25D 3/08; F25D 21/14; F25D 2303/081; F25D 2331/801; F25D 2331/803; F25D 2331/805; F25D 2331/809; A45F 3/04; B67D 3/00; Y10S 220/904

USPC ..... 220/915.2, 915.1, 592.03, 592.26, 592.2, 220/571.1, 571, 630, 628, 739, 737, 904; 62/457.7, 457.5, 457.4, 457.3, 457.2, 62/457.1; 222/572, 569, 567, 608

See application file for complete search history.

(56) References Cited

U.S. PATENT DOCUMENTS

| | | | | |
|---|---|---|---|---|
| 4,143,695 | A | 3/1979 | Hoehn | |
| 4,162,029 | A | 7/1979 | Gottsegen | |
| 4,478,346 | A * | 10/1984 | Spong | F25D 3/08 220/521 |
| 4,873,841 | A | 10/1989 | Bradshaw | |
| 5,131,732 | A | 7/1992 | Lane et al. | |
| 5,551,558 | A | 9/1996 | Bureau | |
| 6,131,732 | A | 10/2000 | Schneider | |
| 6,814,252 | B2 | 11/2004 | Murakami | |
| 9,260,285 | B2 | 2/2016 | Luebbers | |
| 10,005,608 | B1 | 6/2018 | Jacob | |
| 10,173,827 | B1 | 1/2019 | Foote, Jr. | |
| 10,730,685 | B2 | 8/2020 | White et al. | |
| 11,401,102 | B2 | 8/2022 | White et al. | |
| 11,407,579 | B2 | 8/2022 | Munie et al. | |
| 11,772,875 | B2 | 10/2023 | White et al. | |
| 2002/0096916 | A1 | 7/2002 | Combs | |
| 2004/0025530 | A1 | 2/2004 | Perrins | |
| 2004/0045980 | A1 | 3/2004 | Robins | |
| 2005/0082455 | A1 | 4/2005 | Jones | |
| 2007/0277547 | A1 | 12/2007 | Veeravagu | |
| 2008/0178629 | A1 | 7/2008 | Meether | |
| 2008/0237260 | A1 | 10/2008 | Wolek | |
| 2010/0155437 | A1 | 6/2010 | Broadbent | |
| 2010/0212351 | A1 | 8/2010 | Chapin | |
| 2011/0240703 | A1 | 10/2011 | Tobin et al. | |
| 2013/0153591 | A1 * | 6/2013 | Grimes | B65H 75/406 220/735 |
| 2015/0001253 | A1 | 1/2015 | Slaton | |
| 2015/0300730 | A1 | 10/2015 | Diaco | |
| 2015/0375918 | A1 | 12/2015 | Holdemess | |
| 2016/0362124 | A1 | 12/2016 | Vanderberg et al. | |
| 2017/0055665 | A1 | 3/2017 | Lanzisera | |
| 2017/0079413 | A1 | 3/2017 | Guerrero | |
| 2017/0232355 | A1 | 8/2017 | Healy | |
| 2018/0003425 | A1 | 1/2018 | Goodloe | |
| 2018/0199742 | A1 | 7/2018 | Rogers | |
| 2018/0274837 | A1 | 9/2018 | Christensen | |
| 2018/0334287 | A1 | 11/2018 | Schaefer et al. | |
| 2019/0077290 | A1 | 3/2019 | White et al. | |
| 2019/0234671 | A1 | 8/2019 | Stanford | |
| 2022/0170683 | A1 | 6/2022 | Jacob | |
| 2022/0289462 | A1 | 9/2022 | Papera | |
| 2023/0075181 | A1 | 3/2023 | Gautreaux et al. | |
| 2023/0213261 | A1 | 7/2023 | Jacob | |
| 2023/0406603 | A1 | 12/2023 | White et al. | |
| 2024/0228150 | A1 | 7/2024 | White et al. | |
| 2024/0400290 | A1 | 12/2024 | White et al. | |
| 2025/0051086 | A1 | 2/2025 | White et al. | |

FOREIGN PATENT DOCUMENTS

| | | |
|---|---|---|
| CN | 113859734 | 12/2021 |
| CN | 218317951 | 1/2023 |
| DE | 12005035674 | 7/2006 |
| DE | 102005035676 | 7/2006 |
| WO | 9924327 | 5/1999 |
| WO | 2016164271 | 10/2016 |

OTHER PUBLICATIONS

Franklin, Missy, "Wine In A Purse? Boxed Wine Is Getting Classy," The Daily Meal, Sep. 5, 2012, 1 page.

Husted, Kristofor, "No More Shame: Boxed Wine Now Comes In A High-End Fashion Purse," NPR—The Salt, Sep. 3, 2012, 4 pages.

Lacsamanda, Pauline, "Drink on the Go With This Secret Luxury Wine Purse," Yahoo!Life—The Daily Meal, https://www.yahoo.com/lifestyle/drink-secret-luxury-wine-purse-213122581.html, Feb. 14, 2017, 2 pages.

The Daily Meal, "Boxed Wine: Bad Reputation Or Just Bad? Slideshow," https://www.thedailymeal.com/wine-purse-boxed-wine-getting-classy?referrer=yahoo&category=beauty_food&include_utm=1&utm_medium=referral&utm_source=yahoo&utm_campaign=feed, Feb. 6, 2012, 6 pages.

United States Patent Office, Restriction Requirement dated Nov. 6, 2024 in U.S. Appl. No. 18/456,746 (6 pages).

United States Patent Office, Response to Restriction Requirement filed Nov. 8, 2024 in U.S. Appl. No. 18/456,746 (6 pages).

United States Patent Office, Ex parte Quayle Office Action dated Nov. 22, 2024 in U.S. Appl. No. 18/456,746 (22 pages).

United States Patent Office, Reply to Office Action filed Jan. 21, 2025 in U.S. Appl. No. 18/456,746 (4 pages).

United States Patent Office, Notice of Allowance dated Feb. 26, 2025 in U.S. Appl. No. 18/456,746 (8 pages).

Korean Intellectual Property Office; International Search Report and Written Opinion for PCT Application No. PCT/US2025/018534, Jul. 28, 2025, pp. 1-20.

United States Patent Office, Non-Final Office Action dated Feb. 5, 2026 in U.S. Appl. No. 18/616,530 (41 pages).

United States Patent Office, Ex parte Quayle Office Action dated Feb. 24, 2026 in U.S. Appl. No. 18/933,133 (36 pages).

United States Patent Office, Restriction Requirement dated Apr. 7, 2026 in U.S. Appl. No. 19/176,276 (7 pages).

United States Patent Office, Reply to Ex parte Quayle Office Action filed Apr. 15, 2026 in U.S. Appl. No. 18/933,133 (14 pages).

United States Patent Office, Reply to Office Action filed Apr. 21, 2026 in U.S. Appl. No. 18/616,530 (13 pages).

(56) References Cited

OTHER PUBLICATIONS

United States Patent Office, Response to Restriction Requirement filed Apr. 22, 2026 in U.S. Appl. No. 19/176,276 (8 pages).
United States Patent Office, Notice of Allowance dated Apr. 29, 2026 in U.S. Appl. No. 18/933,133 (17 pages).
United States Patent Office, Notice of Allowance dated May 11, 2026 in U.S. Appl. No. 18/616,530 (19 pages).
United States Patent Office, Office Action dated Jun. 2, 2026 in U.S. Appl. No. 19/176,276 (37 pages).
United States Patent Office, Preliminary Amendment filed Jun. 10, 2026 in U.S. Appl. No. 19/198,929 (9 pages).
United States Patent Office, Ex-parte Quayle Office Action dated Jun. 12, 2026 in U.S. Appl. No. 19/198,929 (36 pages).

* cited by examiner

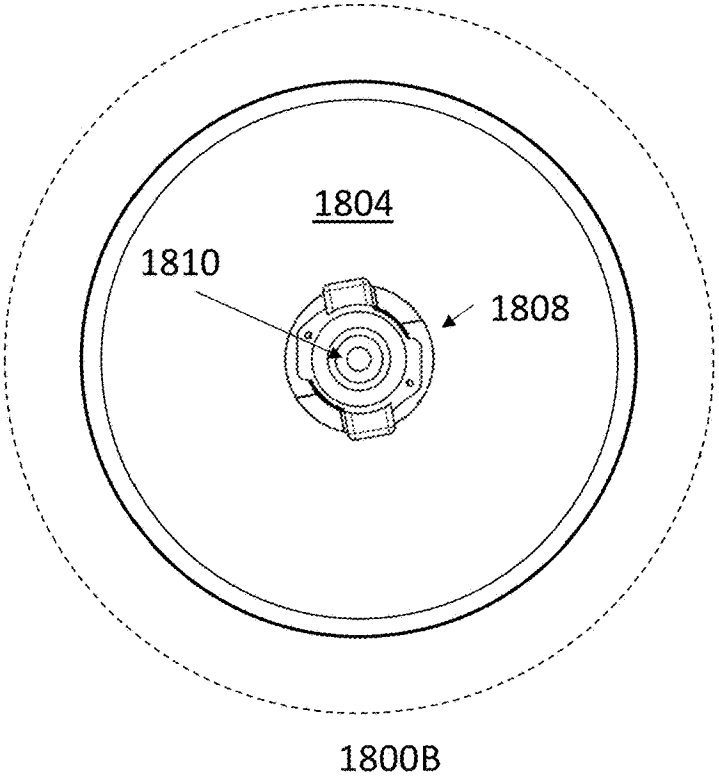
FIG. 18
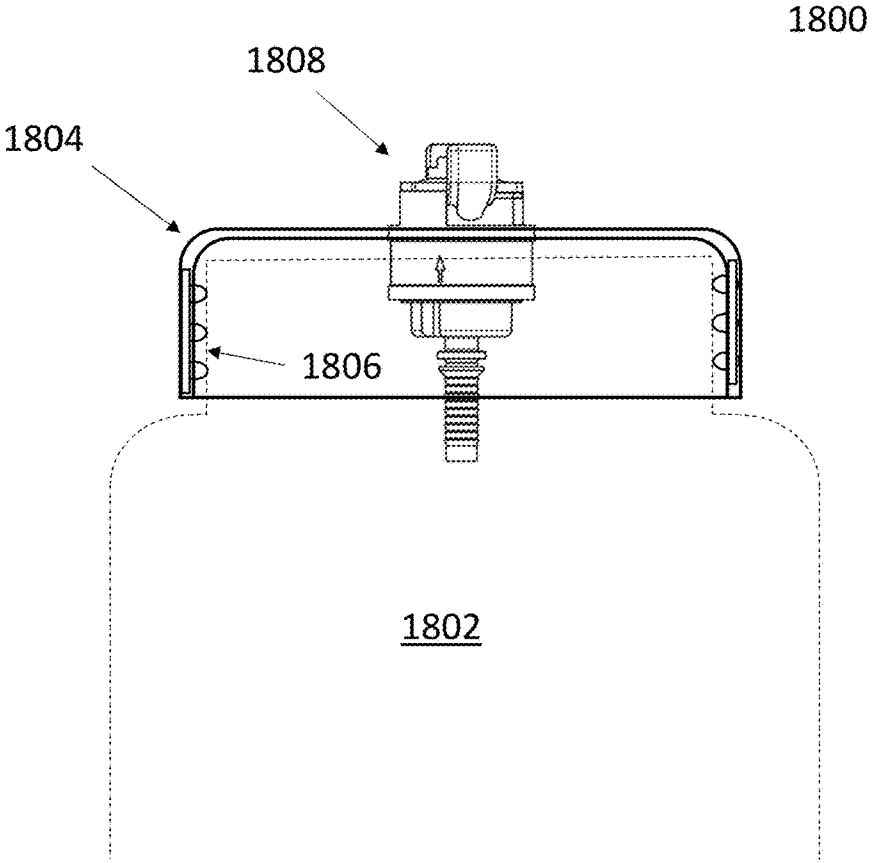

SYSTEM TO HOLD MULTIPLE BEVERAGE CONTAINERS

CROSS-REFERENCE TO RELATED APPLICATION

The present application is a continuation-in-part of Ser. No. 18/616,530, filed Mar. 26, 2024, which is a continuation-in-part of U.S. patent application Ser. No. 18/456,746, filed on Aug. 28, 2023, which is a continuation of U.S. patent application Ser. No. 17/834,348, filed on Jun. 7, 2022, now U.S. Pat. No. 11,772,875, issued on Oct. 3, 2023, which is a continuation-in-part of U.S. patent application Ser. No. 16/943,057, filed on Jul. 30, 2020, now U.S. Pat. No. 11,401,102, issued Aug. 2, 2022, which is a continuation of U.S. patent application Ser. No. 16/115,871, filed Aug. 29, 2018, now U.S. Pat. No. 10,730,685, issued on Aug. 4, 2020, which claims priority to U.S. Provisional Patent Application No. 62/560,295, filed on Sep. 19, 2017, in the names of Russell W. White, Shawn A. Roberts, and Laura J. Roberts, entitled "System To Hold Multiple Beverage Containers," the content of which is hereby incorporated by reference.

FIELD OF THE DISCLOSURE

The present disclosure relates to beverage containers and, more specifically, to a system to hold multiple beverage containers.

BACKGROUND

Beverage containers come in many different sizes and shapes. Beverages may be served in bottles, in cans, in plastic cups, in glasses, and in insulated containers just to name a few. Many of these containers are designed to be hand-held, but there are circumstances that make holding multiple containers at once difficult or dangerous. Moreover, there are times when it is desirable to keep a collection of beverage containers cold or hot for extended periods of time. Aquatic and outdoor activities are frequently enjoyed in areas that do not lend themselves to the use of a refrigerator or an oven, and it is common for a person to want a cold or warm beverage while they are enjoying these types of activities. As such, individuals often need a cooler or other device capable of holding multiple containers and keeping those containers at or near a desired temperature.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIGS. 7A-7C illustrate open and closed views for a given embodiment of a device for holding multiple beverage containers that incorporates teachings of the present disclosure.

FIG. 18 illustrates a beverage container and installed tap cap components of a soft-sided backpack style cooler incorporating teachings of the present disclosure.

DETAILED DESCRIPTION

Figure 1:
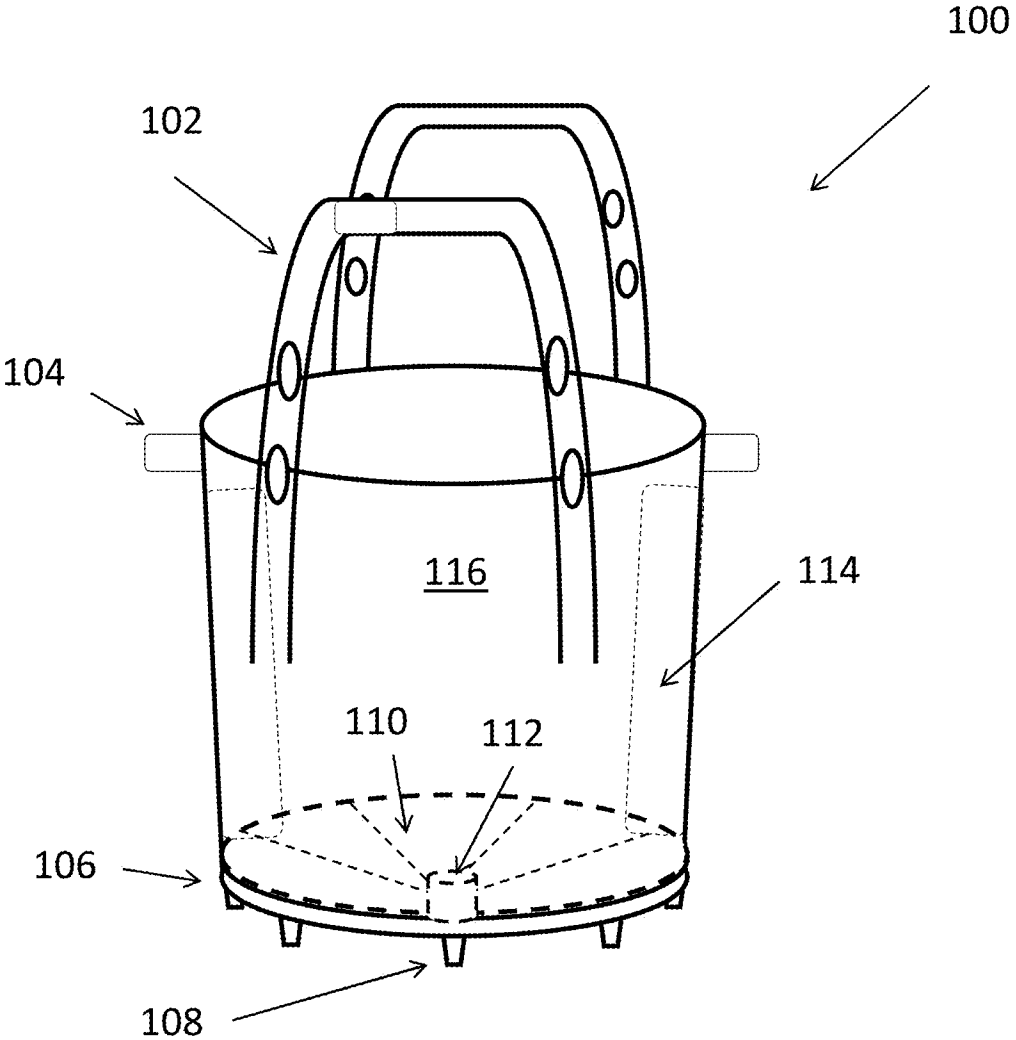
FIG. 1 depicts a general system for holding multiple beverage containers that incorporates teachings of the present disclosure.

The following discussion is intended to provide one skilled in the art with various teachings that can be combined and/or separated to create useful and/or desirable products. The teachings can be employed in a variety of settings. For example, a designer could use these teachings to create an automobile-oriented, boat-oriented, and/or other vehicle-oriented product. Additionally, a designer may want to employ many of these teachings to produce an attractive picnic or beach going type product.

While there are many opportunities for designers to use the teachings disclosed herein, the majority of this detailed description section will focus on embodiments designed for a soft-sided cooler that typically utilizes ice cubes or other frozen objects to facilitate keeping various beverage containers at a desired and chilled temperature. The decision to focus on this implementation is not intended to limit the scope of the teachings, but rather to facilitate a clear presentation of the teachings.

Devices that maintain multiple beverage containers at or near some desired temperature tend to be of two types: hard-sided insulated containers or soft-sided insulated containers. Hard-sided portable insulated containers tend to be made of molded plastic, with an inner layer, or wall, and an outer layer or wall, with an insulation space between. Hard-sided containers are rigid and frequently very heavy. They also tend to be bulky and difficult to carry. A soft-sided cooler, by contrast, can rely on external wall structure that is not substantially rigid. The wall structure may incorporate a multi-layer design that includes an outside layer of webbing or fabric, an inside layer of waterproof webbing or fabric, and a flexible insulation layer positioned between the inner and outer layers. A designer will recognize that layers may be added or removed to meet certain objectives. In some embodiments, a soft-sided cooler may include a rigid or semi-rigid element to give the cooler some stability and to help the cooler maintain a given shape or protect items inside the cooler.

Throughout this description, containers may be referred to as "coolers." Similarly, the portion of the container that opens and closes to facilitate accessing multiple beverage containers stored within the container will typically be referred to as the top of the container. As such, the base panel will typically be referred to as the bottom. The multiple layers that may make up the side walls may be a sandwich of various components. For example, a middle insulating layer may include a flexible or resilient layer of a relatively soft and flexible foam. As noted above, sidewall elements of the cooler may have insulating properties such that heat transfer across the panel is limited. An example of a potential panel construction is an internal core of foam such as closed cell polyurethane foam. The insulating foam is in turn received between a protective, potentially waterproof layer provided on the interior of the container and a potentially decorative layer of polymer sheeting, such as nylon sheeting. As explained in more detail below, a cooler incorporating teachings disclosed herein may include a convertible feature wherein a user can change an exterior panel of the cooler to give it a different look on different occasions or simply to replace a stained or dated exterior shell. In order to maintain the soft-sided characteristics of some embodiments, at least the sidewalls may be formed to be pliable.

To be clear, potential insulated coolers incorporating the teachings of this disclosure may be used to carry cold items such as soda, beer, sandwiches, ice cream, meat, and so on. Alternatively, the insulated coolers can be used to transport hot items such as casseroles, lasagna, vegetables, etc.

With that said and as mentioned above, FIG. 1 depicts a general system for holding multiple beverage containers that incorporates teachings of the present disclosure. Carrier 100 includes toting handles 102, closing tabs 104, and base 106. As depicted, base 106 may have a generally elliptical shape when viewed from above. In addition, base 106 may be formed from a molded plastic, rubber or synthetic rubber material. A designer may choose other materials to meet design objectives. As shown, base 106 includes feet 108, which may be formed as an integral part of base 106. For example, if base 106 is a molded part, feet 108 may be included in the mold. A more detailed description of what a base like base 106 may look like is included in connection with FIG. 4A.

As depicted in FIG. 1, base 106 includes a generally conic tapering drain floor 110 that makes up its top surface (as shown, feet 108 are on the bottom surface). Tapering drain floor 110 may facilitate the draining of carrier 100 by directing water (which may have resulted from melting ice) toward drain 112. As shown, drain 112 defines a hole that passes through the thickness of base 106 and allows water to escape an internal cavity of container 100 that is at least partially formed by sidewalls 116, which may be formed as a multi-layer wall where different layers perform different desired functions. For example, an inside layer closest to the internal cavity may be a waterproof layer, a middle layer may be an insulating layer, and an external layer may be a decorative layer.

As shown, beverage sleeves 114 are shown as being inside container 100. Depending on design concerns, beverage sleeves 114 may be formed from a stretch fabric, which may be a synthetic fabric that stretches. The stretch fabric may be a multi-way stretch fabric such as 2-way stretch or 4-way stretch. An exemplary 2-way stretch fabric may stretch in one direction, such as from selvedge to selvedge (but can be in other directions depending on the knit). An exemplary 4-way stretch fabric, such as spandex, may stretch in both directions, crosswise and lengthwise. A given stretch fabric may include fibers of neoprene. Example stretch fabrics could include elastomerics like spandex or Lycra. With that said, a designer could choose whichever stretch fabric he or she wanted to accomplish a given deign goal. A deeper understanding of the potential benefits of beverage sleeves 114 may be understood by referencing the next figure.

Figure 2:
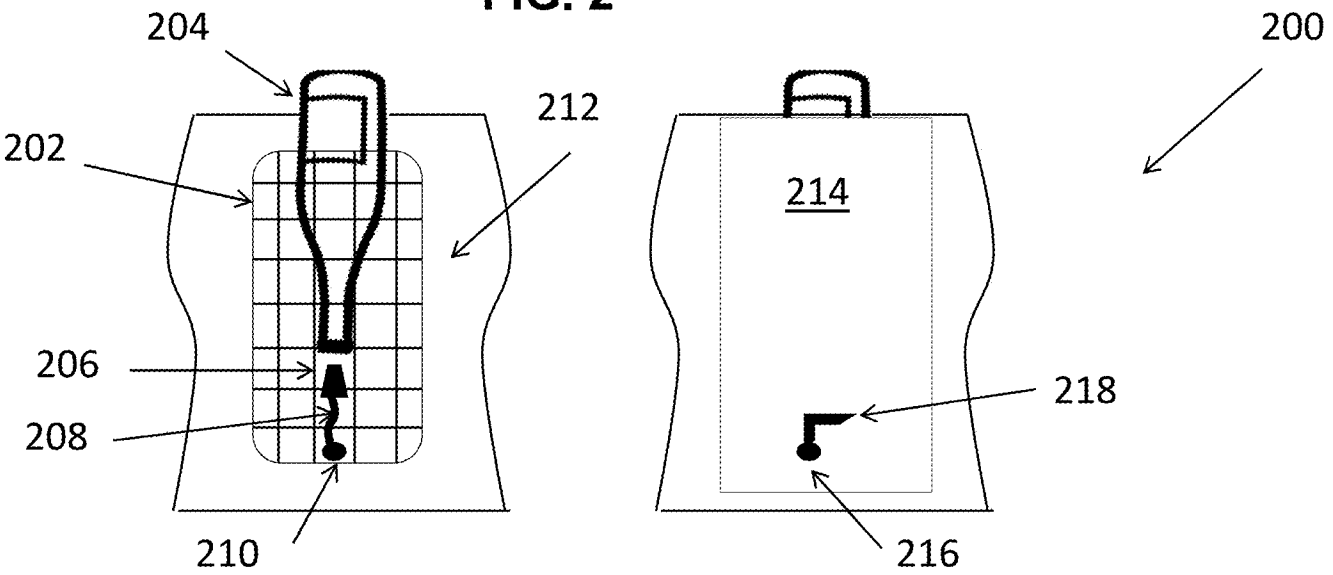
FIG. 2 illustrates an element of a given embodiment of a device for holding multiple beverage containers that incorporates teachings of the present disclosure.

As mentioned above, FIGS. 2 and 3 illustrate elements of a given embodiment of a device for holding multiple beverage containers that incorporates teachings of the present disclosure. As depicted, system 200 provides a beverage sleeve designed to maintain a bottled beverage 204 within a beverage sleeve 202. Sleeve 202 is depicted as having a grid pattern. A designer may choose any number of patterns. In some embodiments, sleeve 202 may not include holes larger enough for even small ice cubes to pass from one side to the other of sleeve 202. In such an embodiment, ice placed within a container like container 100 will not easily makes its way inside a sleeve like sleeve 202. This may make it easier for a user to remove and then replace bottled beverage 204 from sleeve 202.

As depicted, sleeve 202 is located inside and connected to inside wall surface 212. Also on the inside is plug 206 and tube 208. In practice, a user may remove the lid from bottled beverage 204 and insert plug 206 into the bottle's open end. The beverage inside may then be able to pass through the open end, through a hole within insert plug 206 and into tube 208, which is connected to plug 206. Tube 208 may be routed to and/or through port 210, which may allow the beverage inside the bottle to makes its way from the inside of a container to a dispensing port 216, which may located on or near an outside wall surface 214. Depending upon designer concerns, dispensing port 216 may be controlled by any number of devices. As shown, dispensing port 216 includes a lever-operated stopcock 218. One of skill in the art may choose other mechanisms such as a push button, etc. As shown, a container like container 100 that incorporates the elements of system 200 may allow a user to open a bottle of wine, connect the bottle to a dispensing mechanism (the one depicted uses gravity, but various pressuring mechanisms and/or other methods could be used), place the bottle inside the cooler, close the cooler, and enjoy the wine without having to reopen the cooler.

Figure 3:
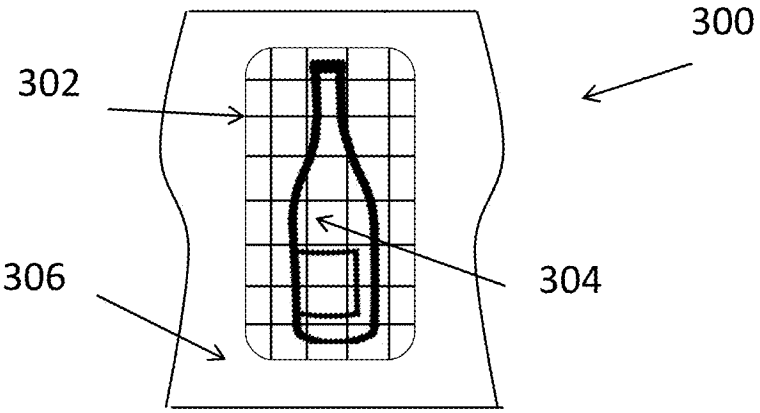
FIG. 3 illustrates an element of a given embodiment of a device for holding multiple beverage containers that incorporates teachings of the present disclosure.

FIG. 3 depicts a system 300 that removes the dispensing mechanism. Some users may prefer to simply place a bottle 304 within a sleeve 302 located along inside wall surface 306. Such an embodiment keeps bottle 304 cool and makes its easy to remove and replace bottle 304 within a container like container 100. As depicted in the first three figures, a container like container 100 may be proportioned such that a bottled beverage can be placed within a sleeve while still allowing the container to be closed. This helps keep the bottle upright while it is within the cooler. The sleeve also allows a user to benefit from the ice within a cooler as it keeps the bottle cool without having to "fight" the ice to fit the bottle back inside the cooler.

Figure 4A:
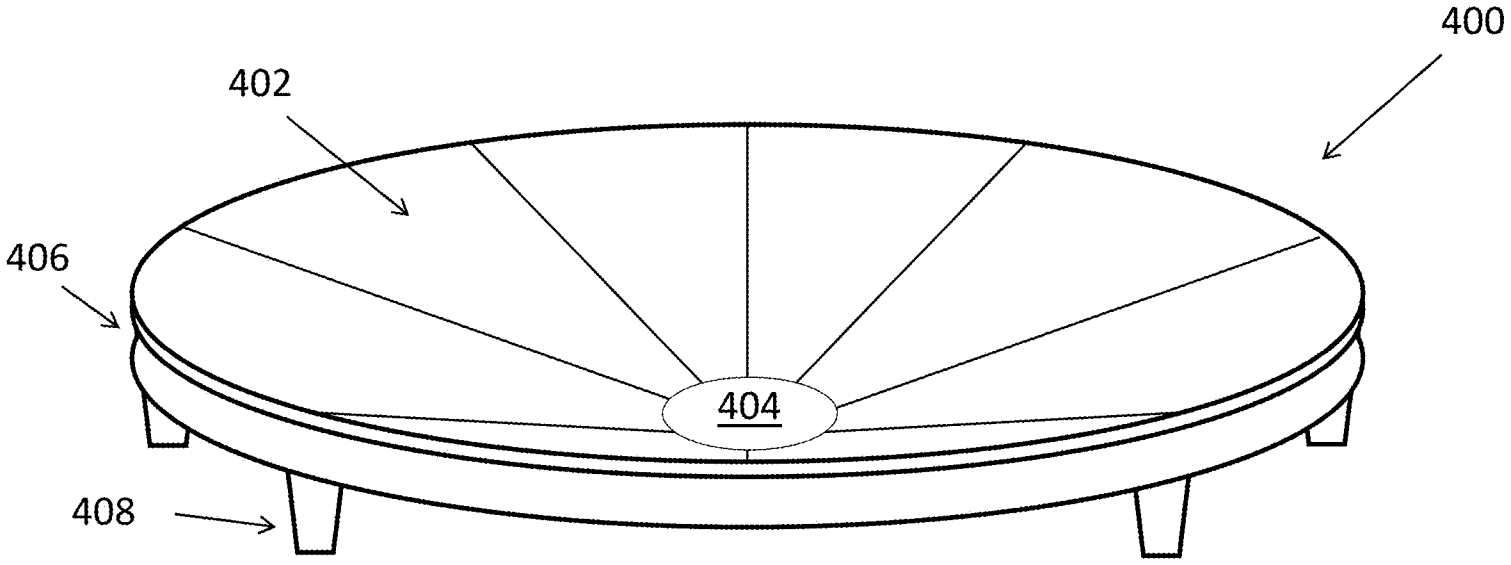
FIGS. 4A and 4B illustrate a base option for a given embodiment of a device for holding multiple beverage containers that incorporates teachings of the present disclosure.

As mentioned above, FIGS. 4A and 4B, and FIG. 5 illustrate base options for a given embodiment of a device for holding multiple beverage containers that incorporates teachings of the present disclosure. Base 400 is largely depicted as a single piece of material. A designer could utilize this technique or combine several different pieces to meet his or her objectives. As mentioned above, a designer could also choose from various materials to form base 400. It could be a rubber, a synthetic rubber, a plastic, a metal, a composite, and/or various other options. It could be injection molded, molded in other ways, 3D printed, formed, etc. As shown in FIG. 4A (a perspective view looking at the top of base 400), base 400 has a symmetrical draining geometry 402 directing water to a centrally located drain 404. A designed may also choose an asymmetrical geometry.

As shown, base 400 has a generally elliptical shape. In practice, the size, shape, and weight of base 400 may be chosen to facilitate a container's ability to maintain itself in an upright position. Base 400 is also depicted as having multiple feet 408 and a couple ridge 406. In practice, base 400 may be formed of a material that is different that the multi-layer sidewalls of a cooler utilizing base 400. Moreover, base 400 may be formed in separately and in a different location. It may be brought together with the sidewalls during a manufacturing process. As such, ridge 406 may facilitate a mating of base 400 with a sidewall of a designer's choosing.

Figure 4B:
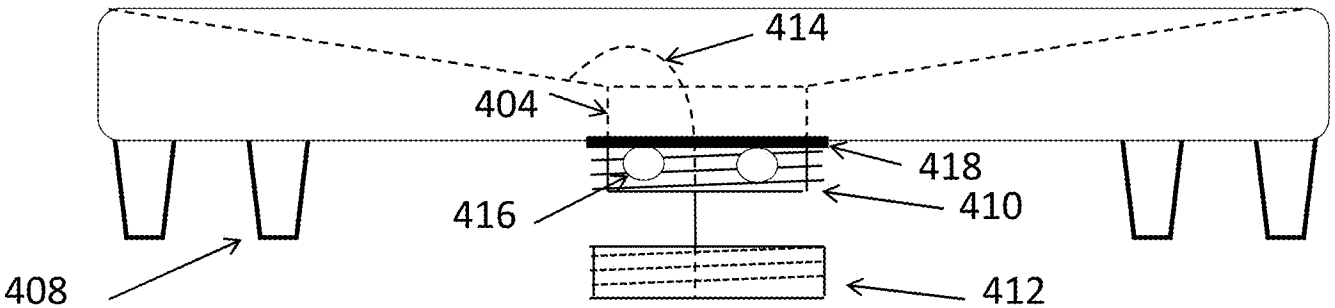
Figure 5:
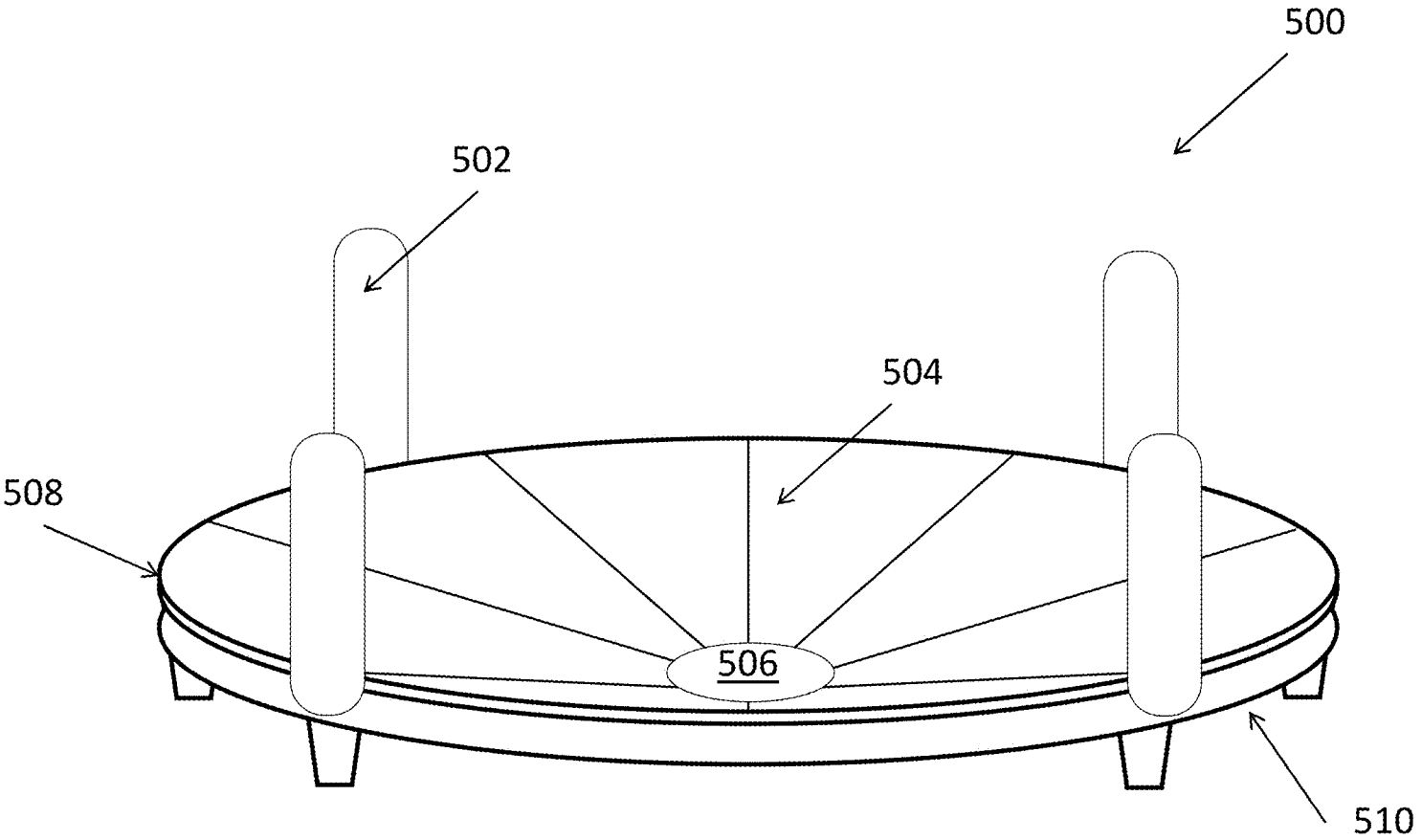
FIG. 5 illustrates a base option for a given embodiment of a device for holding multiple beverage containers that incorporates teachings of the present disclosure.

FIG. 4B presents a side view of base 400, which indicates a thickness to the body of the base. As shown in this embodiment, feet 408 are sufficient long to allow the body of base 400 to be elevated from a surface upon which feet 408 rest. Drain 404 extends through base 400 and an extended portion of drain 404 includes a threaded surface 410. As shown, the male threads of threaded surface 410 are designed to interact with the threaded surface located within cap 412, which is tethered to base 400 via securing tether 414. A designer may choose any number of techniques (or no technique at all) to ensure that cap 412 is not easily lost. The tethering option depicted is just one option. As shown, threaded surface 410 includes drain ports 416. In some embodiments, a designer may design the system in a manner that allows a user to unscrew cap 412 without allowing for cap 412's complete disconnection from base 400. In such an embodiment, ports 416 may allow water to escape from within the cooler without risking the loss of cap 412. As shown, ring 418 is included. Ring 418 may be, for example, a rubber O-ring that helps ensure a waterproof seal when cap 412 is secured to base 400 via threaded surface 410.

As mentioned above, FIG. 5 illustrates a base option, base 500, for a given embodiment of a device for holding multiple beverage containers that incorporates teachings of the present disclosure. As shown, base 500 includes four stiffening tabs 502. In practice, tabs 502 may assist in keeping a soft-sided cooler in an upright position by acting in a skeleton like manner. Providing some vertical structure, tabs 502 may help keep a cooler from tipping over. Base 500 also includes a draining geometry 504. As shown, geometry 504 may create a generally symmetrical and conical void directed toward drain 506. As mentioned above, drain 506 may be located nearer a given edge in some designs as opposed to in the center. Similarly, a base may take on a square, rectangular, triangular, elliptical, circular, etc. shape. Base 500 also includes an interior material coupling ridge 508 and an exterior material coupling ridge 510. As mentioned above, soft-sided sidewalls may be formed with a multi-layer offering. An interior facing material may be a waterproof material. A middle layer may be an insulating material. In some embodiments, a third layer may be used to encapsulate the insulating layer between the interior layer and the third layer. A designer may want such a three layer "bag" to be coupled to the base along coupling ridge 508, which could also be located closer to drain 506. The methodology for connecting the "bag" to the base could take several forms. It could be a near permanent connection or an easily removed connection. It could include adhesives, heat treatments, zipping solutions, etc.

In such a system, the designer may want to offer users an interchangeable exterior layer that could be, for example, more decorative. In such a system, the designer may want the exterior layer to couple to the base at ridge 510. For example, an exterior layer may utilize a zipper to connect to base 500. The exterior could also use other connection techniques. For example, the exterior layer may include straps that connect underneath base 500. However connected, an interchangeable exterior layer may allow users a great deal of flexibility in changing the appearance and/or replacing an existing worn or tattered exterior shell. As shown, tabs 502 may be located between an interior multi-layer "bag" and an exterior layer.

Figure 6:
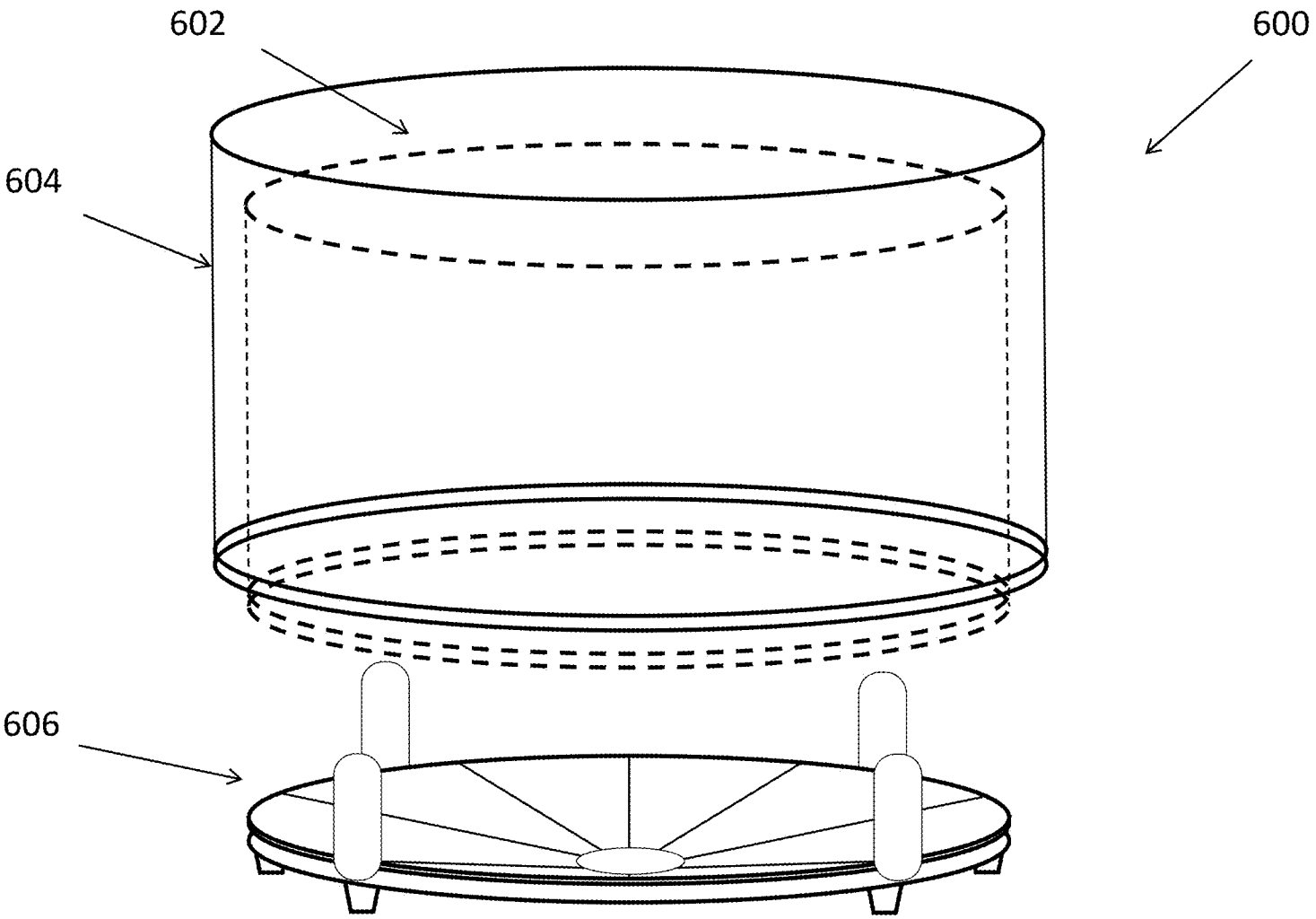
FIG. 6 illustrates an exploded view for a given embodiment of a device for holding multiple beverage containers that incorporates teachings of the present disclosure.

FIG. 6 illustrates an exploded view for a given embodiment of a device for holding multiple beverage containers that incorporates teachings of the present disclosure. System 600 an interior material or multi-layer material 602, and exterior material 604, and a base 606. In practice the three pieces may be manufactured separately from one another and then assembled into a complete system 600.

Figures 7A, 7B:
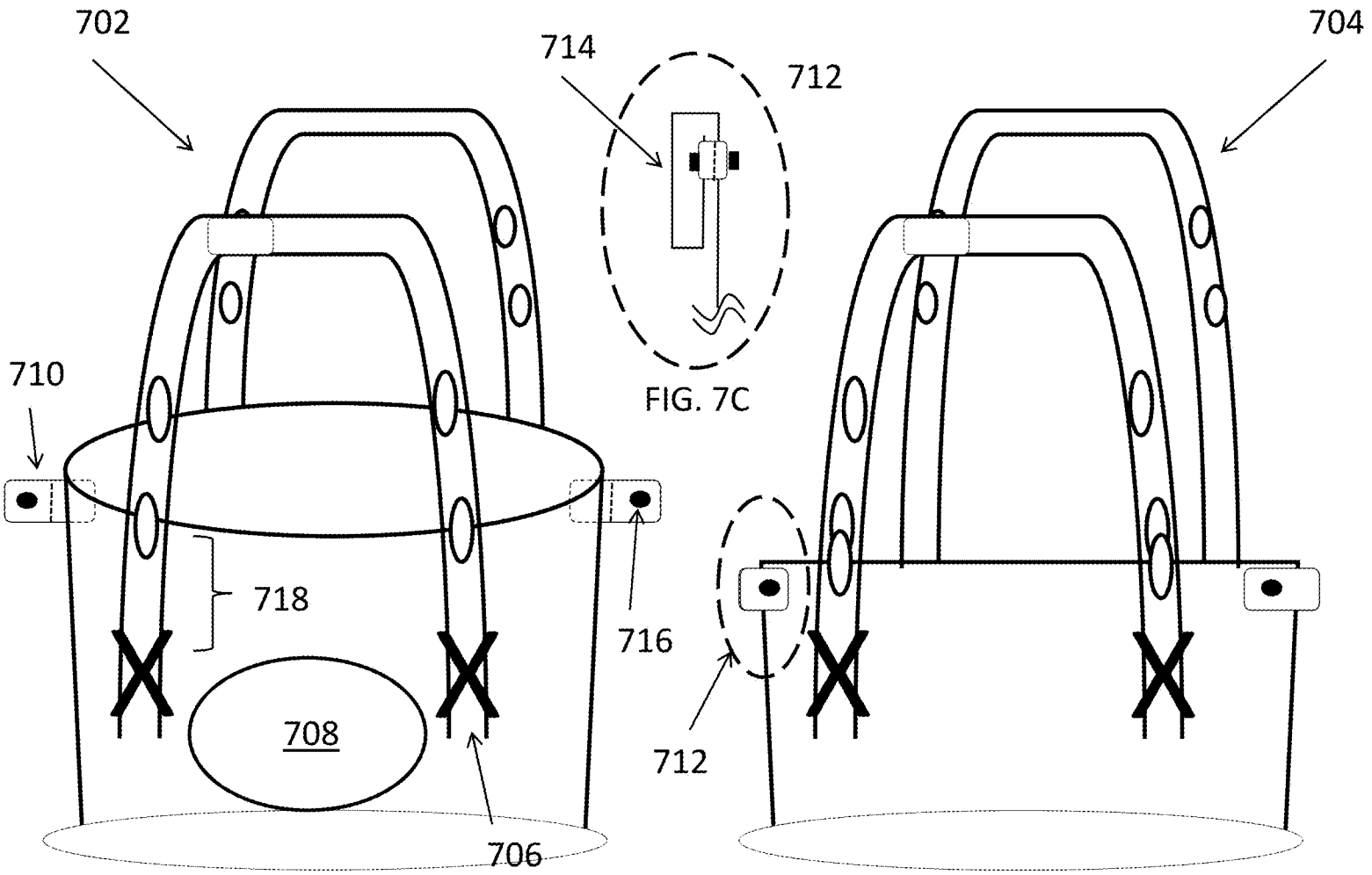

FIGS. 7A-7C illustrate open and closed views, respectively, for a given embodiment of a device for holding multiple beverage containers that incorporates teachings of the present disclosure. As shown, carrier 702 is an open configuration allowing easy access to the interior void of the carrier. Carrier 704 presents a closed configuration of the container. As shown on carrier 702, handles are connected to an exterior surface using stitching 706. The location of stitching 706 relative to the top of opened container 702 may be chosen to leave sufficient distance 718 to allow a rolled or folded closing of carrier 702. Carrier 702 also includes a branding or monogramming surface 708 and magnetic tab closers 710.

As shown with carrier 702, magnetic tabs 710 are in an open position. The tabs are in a closed position 712 in connection with carrier 704 and FIG. 7C. As shown more clearly in FIG. 7C, container sidewall 714 is folded over itself twice and magnetic tabs 710 are in a closed position. In use, magnet 716 is attracted to another magnet on the other end of tab 710. When the top of the container is folded over itself, magnetic tab 710 may be folded in half to bring magnet 716 into close proximity with the magnet on the other end of tab 710. In the folded or closed position, the two magnets hold tab 710 closed and assist in insulating the interior portion of the container.

Figure 8:
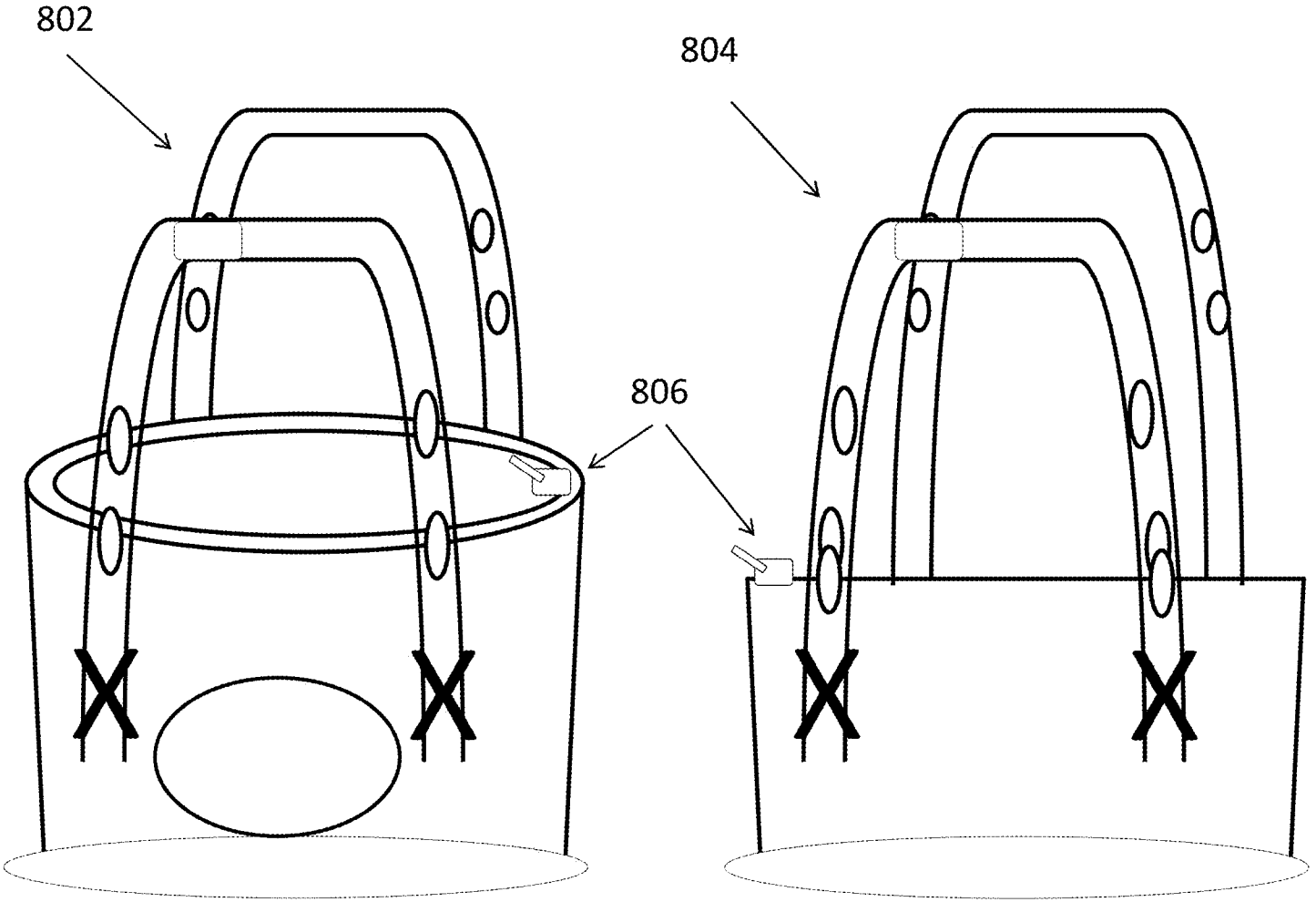
FIG. 8 illustrates an open and closed view for a given embodiment of a device for holding multiple beverage containers that incorporates teachings of the present disclosure.

FIG. 8 illustrates an open 802 and closed 804 view for a given embodiment of a device for holding multiple beverage containers that incorporates teachings of the present disclosure. In the embodiment of FIG. 8, the opening and closing mechanism is a zipper or zip-lock type of locking mechanisms 806. A designer may choose whatever type of closing mechanism works for his or her design.

Figure 9A:
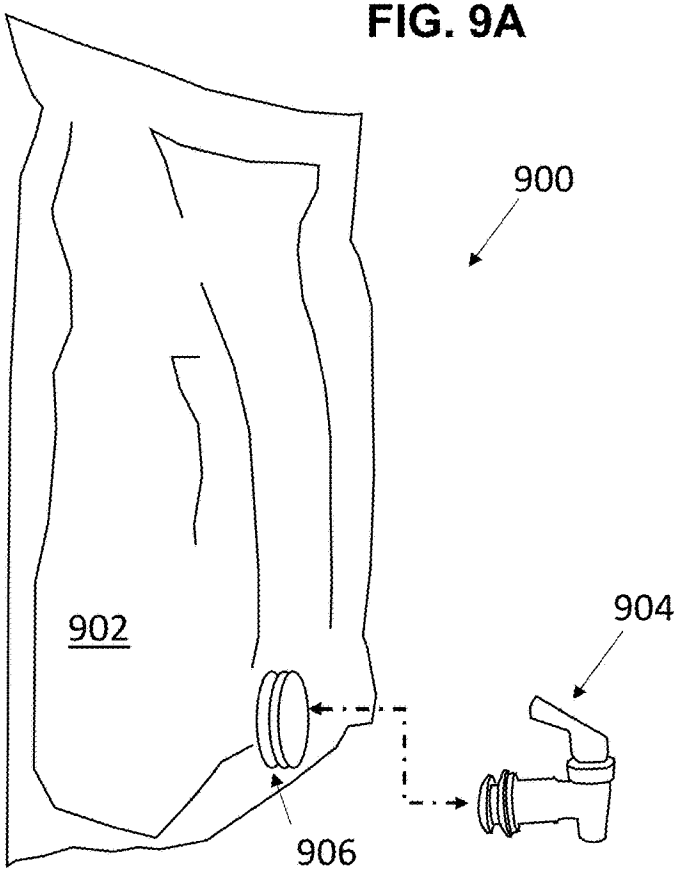
FIG. 9*a* illustrates a refillable beverage container incorporating teachings of the present disclosure.
Figure 9B:
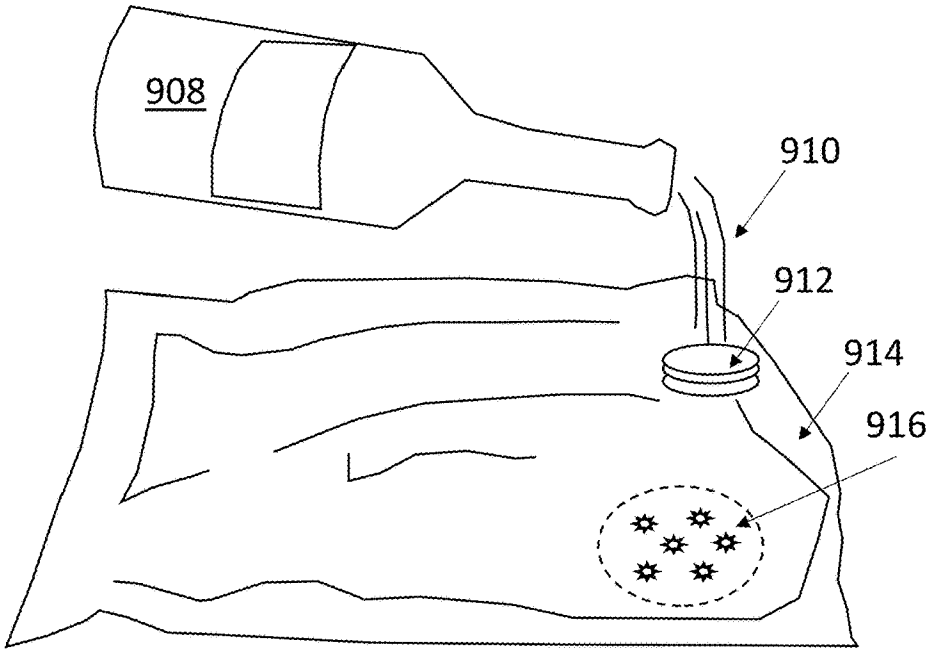
FIG. 9*b* illustrates a process for filling a bag incorporating teachings of the present disclosure.

As mentioned above, FIG. 9 illustrates a system 900 that includes a bag 902 that may be filled with a liquid. In practice, the bag may be sized to hold 750 ml (a typical bottle of wine), 1500 ml (two typical bottles of wine), and/or some other amount chosen by a designer. Bag 902 may be refillable. For example, bag 902 might have a removeable dispensing mechanism 904. A user may remove mechanism 904 from attachment location 906 and pour a liquid inside bag 902. At some point, the user may empty bag 902, clean bag 902, and refill bag 902 with a similar or different liquid. Though bag 902 is depicted as having a removable dispensing mechanism 904, a designer may elect to have a dispensing mechanism that is not removeable. In such a system or even in a system with removable dispensing mechanism, a designer may want a top portion of the bag to be capable of being opened and resealed like a zip-to-lock closing mechanism. Other methodologies for opening a bag to allow the addition of a liquid and then resealing the bag could also be employed without departing from the spirit of the teachings disclosed herein.

As mentioned above, FIG. 9*b* illustrates the act of filling a bag in a manner that incorporates teachings of the present disclosure. As shown, a bottle 908 is pouring a liquid 910 through a hole 912 to fill bag 914. As depicted bag 914 has a dehydrated drink mix 916 located within it. In practice, drink mix 916 may be placed within bag 914. The drink mix 916 may interact with the liquid 910 to form a preferred beverage.

Ingredients that may be included with drink mix 916 could be, for example, one or more of granulated honey, citric acid, malic acid, lemon oil, lemon juice, sugar, lime oil, lime juice, ascorbic acid, dried cane syrup, crystalized lime, crystalized lemon, cranberry powder, tomato powder, worcestershire sauce powder, distilled vinegar, molasses powder, spices, tamarind, sulfiting agents, maltodextrin, silicon dioxide, celery salt, sea salt, celery seed, cayenne pepper, orange powder, bitters powder, tangerine juice, almond flavor powder, crystalized grapefruit, grapefruit oil, grapefruit juice, licorice powder, etc.

Figure 10:
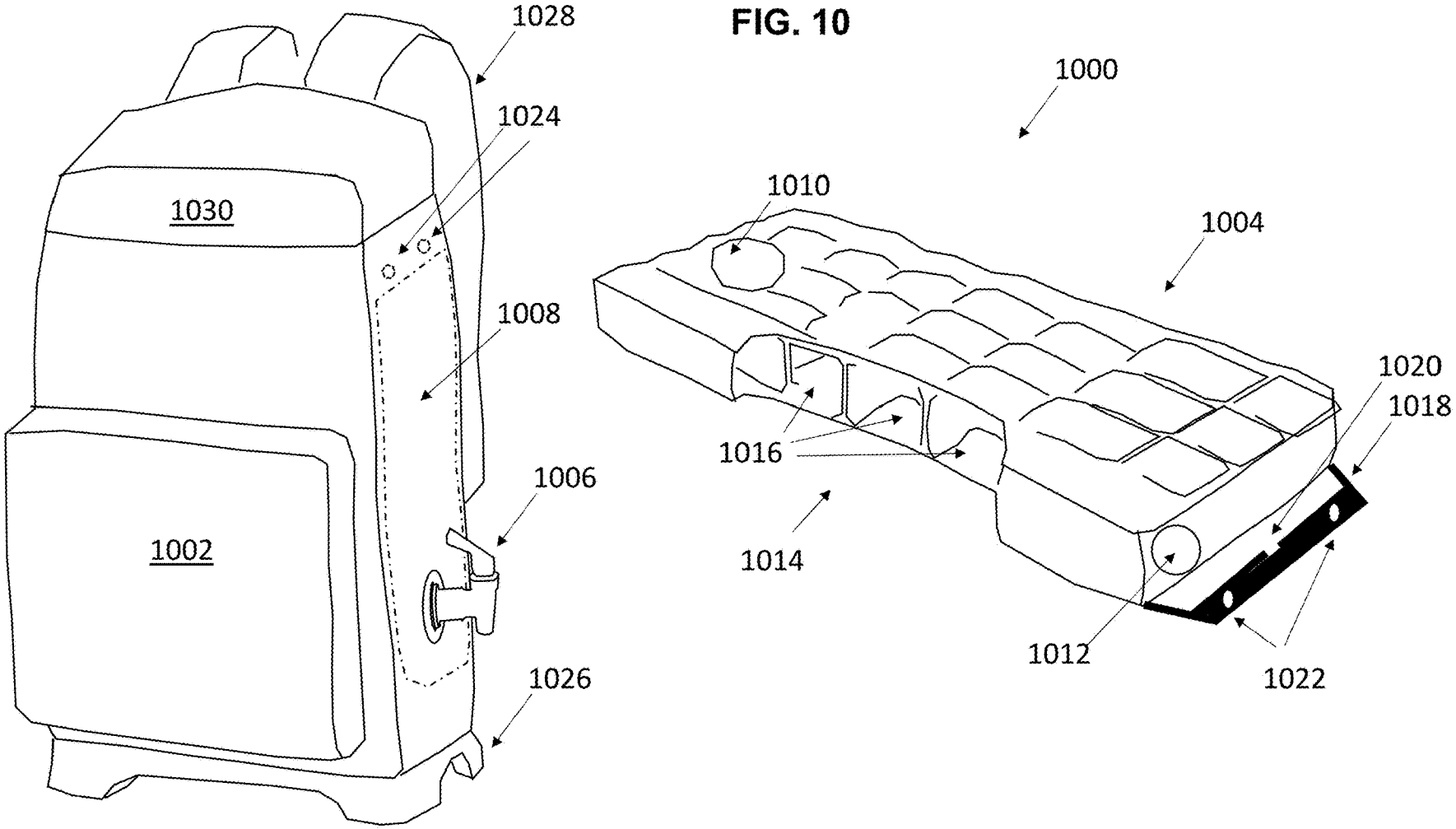
FIG. 10 illustrates a soft-sided backpack style cooler and refillable container system incorporating teachings of the present disclosure.

In some cases, dried combinations of these and other ingredients could allow a designer to offer a cocktail bag option. For example, a designer could offer a margarita bag that includes a drink mix including sugar, citric acid, lime oil, lime juice, ascorbic acid, and dried cane syrup. In practice, a user could add water and tequila to the bag (perhaps one part water and two parts tequila), replace a removable dispensing mechanism, shake, and ultimately mount the bag inside a cooler sleeve as described more fully in FIGS. 10 and 11.

Cocktail options could include margaritas, cosmos, bloody mary's, old fashioneds, mai tais, daiquiris, palomas, bee's knees, etc. And, liquids to be added could include water, gin, tequila, rum, whiskey, bourbon, vodka, etc. A user may not necessarily want an alcoholic cocktail. As such, non-alcoholic cocktails could be used. Similarly, red wines, white wines, roses, sparkling wines, orange juice, water, etc. could be placed in a bag like bag 914. In some cases, a designer may choose to provide a backpack cooler with a collection of different drink bags. A user may be able to join a club and request different drink mixes on some periodic schedule.

As mentioned above, FIG. 10 illustrates a system 1000 that includes a soft-sided backpack style cooler 1002 and a refillable container system 1004 incorporating teachings of the present disclosure. As depicted, backpack cooler 1002 is a soft-sided cooler with a drink dispenser 1006 and a drink sleeve 1008. As shown drink sleeve 1008 is located inside cooler 1002. At least a portion of sleeve 1008 may be made from a stretch fabric. For example, a bottom portion may be capable of stretching enough to allow a bag with a dispenser attached (like bag 902) to be easily placed with sleeve 1008 in a manner that allows a dispenser to extend outside the cooler at least far enough to allow a user to access and operate the dispenser without re-opening the cooler.

As shown, the refillable container 1004 has two potential locations for adding a liquid, openings 1010 and 1012. Container 1004 is also depicted with a cutaway view 1014 to reveal an internal, multi-chamber structure. In practice chambers 1016 may be interconnected and open to one another in a manner to allow liquid to flow between them. The structures may also be attached to both a top and bottom surface of container 1004 in a manner that helps container 1004 maintain a generally rectangular cuboid shape. Of course, a designer may choose other shapes and/or techniques to facilitate a container's ability to maintain a shape as liquid is added and/or removed from the container. For example, a user may use a rigid or semi-rigid material. Regarding materials, a designer may elect a flexible foil material, a rigid plastic material, a flexible plastic material, a leather material, a rubber material, a metal material, a composite material, etc.

In some cases, a designer might choose a rectangular cuboid shape with approximate dimensions of 9 inches by 10 inches by 1 inch. Some designers might also choose dimensions like 8½ inches by 10 inches by 1¼ inches. A designer might choose dimensions like these based upon a desired volumetric capacity such as around 1500 ml. As such, a designer might also choose dimensions like 7 inches by 5 inches by 1⅓ inches in an effort to provide a user with a 750 ml capacity.

Referring back to FIG. 10, container 1004 may include a hanger 1018 with a hanging notch 1020 and/or hanging holes 1022. In practice, hanger 1018 may facilitate a proper location within sleeve 1008. As shown, protrusions 1024 are located within cooler 1002. In the depicted system, protrusions 1024 are sized and located in a manner to allow for an interference fit within holes 1022. In practice a user may fill container 1004 with a desired liquid, slide container 1004 within sleeve 1008, and removably secure container 1004 in place by pressing holes 1022 onto protrusions 1024.

Other techniques of location container 1004 may be utilized. For example, notch 1020 may allow for hanging container 1004 from a hook or other mechanism located with cooler 1002. In another embodiment, a designer could make use of a hook and loop type attachment mechanism for attaching container 1004 in place.

Figure 11:
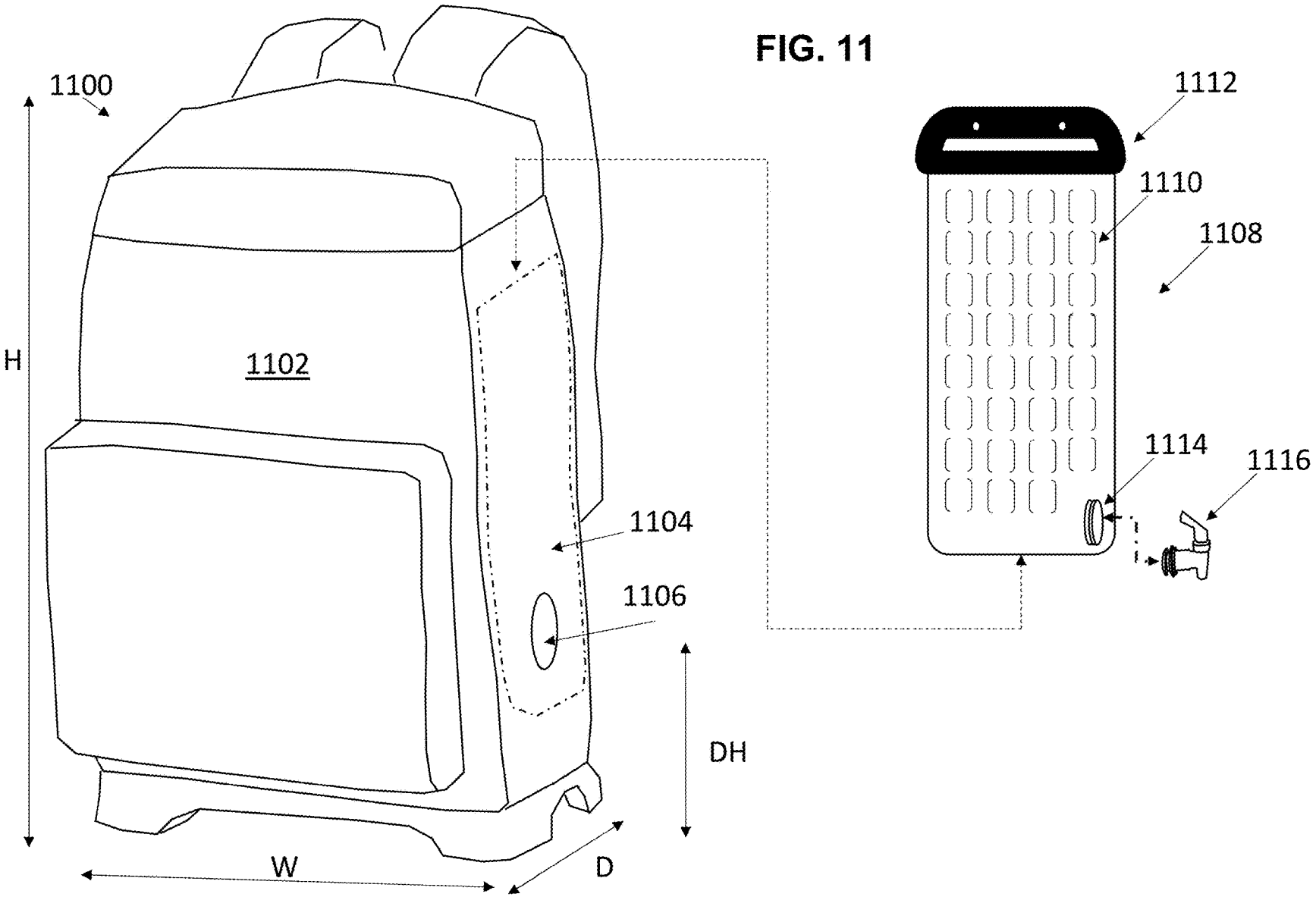
FIG. 11 illustrates a soft-sided backpack style cooler and refillable container system incorporating teachings of the present disclosure.

As shown, cooler 1002 has a base 1026 that includes feet. Cooler 1002 also includes toting straps 1028 and a hinge type lid 1030 for accessing an interior portion of cooler 1002. As mentioned above, FIG. 11 illustrates a similar system 1100 that includes a soft-sided backpack style cooler 1102 with an internal beverage sleeve 1104 and a hole 1106 formed to allow a drink dispensing mechanism to be extend from within the cooler to a location accessible to a user outside the cooler. System 1100 also includes a refillable container system 1108 incorporating teachings of the present disclosure. Container system 1108 has a multi-chambered internal structure as indicated by a tufted appearance on its external surface 1110. Container system 1108 also includes a hanger 1112, an attachment location and mechanism 1114, and a dispensing system 1116. In practice, location and mechanism 1114 allows for a snap and seal connection with dispensing system 1116 that allows dispensing system 1116 to be removed and replaced in a manner that maintains a water tight or near water tight connect when connected. In some system, a designer may not want to rely upon this type of sealing solution. In some cases, a dispensing system may be non-removably sealed in place using radio frequency welding. For example, a designer may choose to use a PVC material, a polyurethane material, etc., for the bag and dispensing system and then "weld" the two together using radio frequency welding to create a water-tight seal. In such a system, the designer may allow the top of a container to be opened and closed using a zip-to-lock type closing mechanism or some other appropriate closure that facilitates adding a liquid to a container and then sealing the liquid within the container. As shown in FIG. 11, a filled container system 1008 may be placed within cooler 1102 and inside sleeve 1104 in a manner that allows dispensing system 1016 to extend through 1106.

Depending upon design concerns, a designer might choose to form hole 1106 approximately 7-10 inches above a surface the cooler is resting on. In such a system, a user might find it easier to place a glass or cup under dispensing system 1016. As such, DH might be 7-10 inches. Similarly, H might be over 20 inches, W might be over 16 inches, and D might be over 9 inches. Other sizes could also be used. For example, H, W, and D could be adjusted to accommodate a given container size a designer wants to use recognizing that a backpack cooler might include an insulation layer that is ½ inch thick or thinner to 1½ inches thick or thicker. As such, if a designer wants to create a 1500 ml container with a dispensing port that is 8 inches off the ground, the designer may choose to create a backpack cooler with an internal height dimension of over 18 inches, an internal depth dimension of over 9 inches, and an internal width dimension of 16 inches. Assuming a 1 inch insulation layer and a 2 inch tall base, the designer may produce a backpack cooler with an H of over 20 inches, a W of over 18 inches, and a D of over 11 inches. The overall size and appearance may depend on designer preferences.

Figure 12:
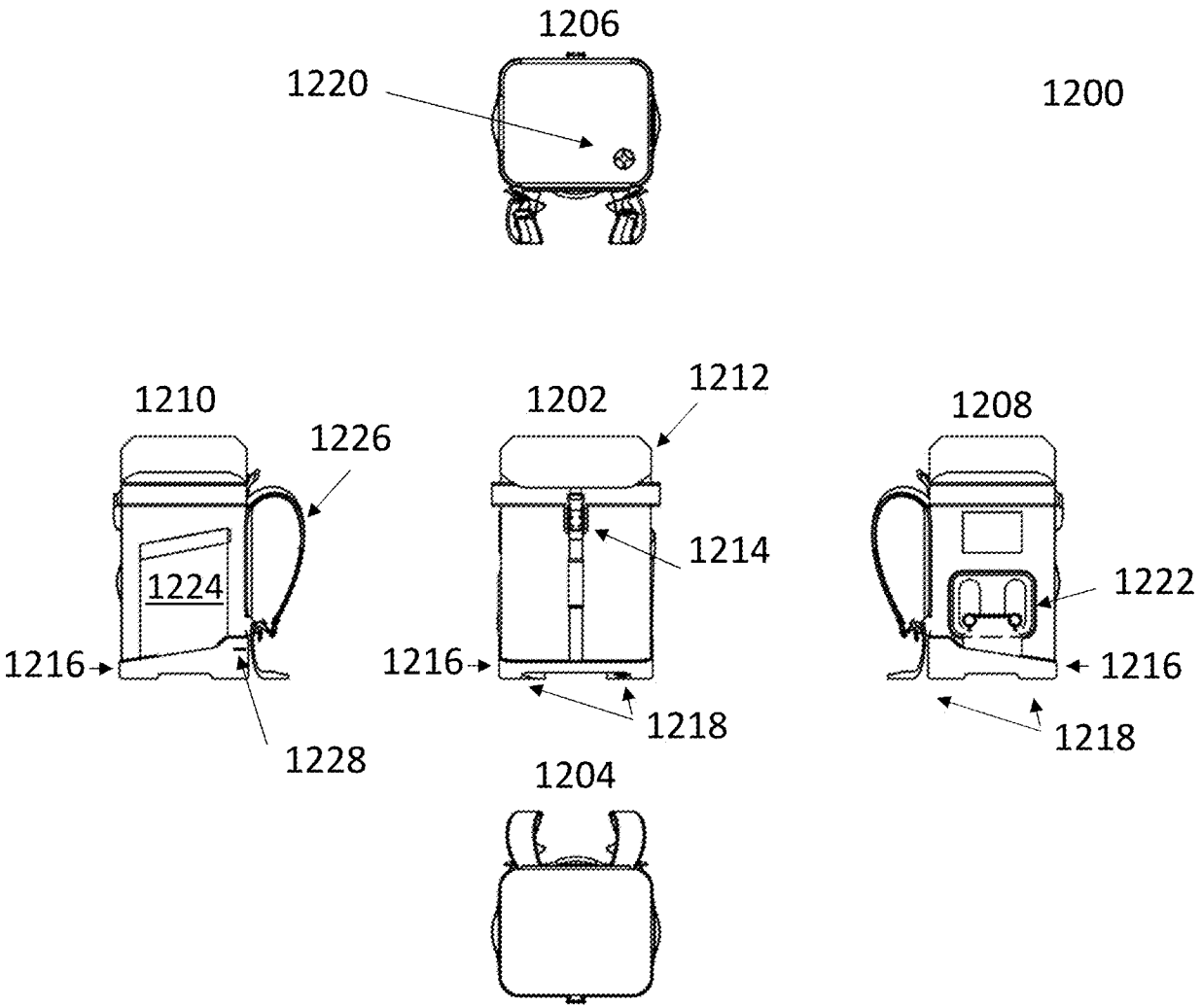
FIG. 12 illustrates several views of a soft-sided backpack style cooler and refillable container system incorporating teachings of the present disclosure.

As mentioned above, FIG. 12 illustrates several views of a soft-sided backpack style cooler and refillable container system 1200 incorporating teachings of the present disclosure. The five depicted views are as follow: front view 1202, top view 1204, bottom view 1206, right side view 1208, and left side view 1210.

Front view 1202 shows a lid 1212, which may be opened to provide access to an interior portion of the cooler. Lid 1212 may also be closed to secure various thigs within the cooler. In one embodiment, lid 1212 is designed to utilizes magnets to securely close the cooler. In addition, a latch 1214 may be utilized to ensure a tight and secure closing. In some embodiments, latch 1214 may be formed of a metal and incorporate a bottle opener into its design. Front view 1202 also shows base 1216. In some embodiments, base 1216 may be formed of a more rigid plastic, a rubber, a nylon, and/or some other material or combination of materials. As shown, base 1216 has feet 1218 extending downward. In the depicted embodiment, the cooler has four feet 1218 though other amounts could be chosen by a designer. In addition, bottom view 1206 shows a drain plug 1220 incorporated into base 1216. As shown, drain plug 1220 may thread in and out of base 1216. In some embodiments, plug 1220 may not actually be removed from base 1216, but rather unscrew enough to allow liquids trapped inside the cooler to drain but no so far that plug 1220 falls out and completely separates from base 1216.

In right side view 1208, base 1216 and two feet 1218's can be seen. In addition, dispensing region 1222 is visible. In practice, a tumbler with a tap cap lid (depicted more fully in FIG. 18) may be inverted and inserted into a silo to mate with a mating plug. The beverage inside the tumbler may then be able to pass through the open end of the tap cap lid, through a hole within a mating plug (like mating plug 1510) and into a tube (like tube 1512), which is connected to a mating plug. The tube may be routed to and/or through a port or hole formed through a sidewall of the cooler, which may allow the beverage inside the tumbler to makes its way from the inside of a container to one of the two dispensing ports located on or near an outside wall surface within dispensing region 1222.

In left side view 1210, an expandable pocket 1224 is visible. Also visible is a shoulder strap 1226, which may be used to help tote the cooler around on a user's back. As shown, strap 1226 may connect to base 1216 at a slit 1228 formed through base 1216.

Figure 13:
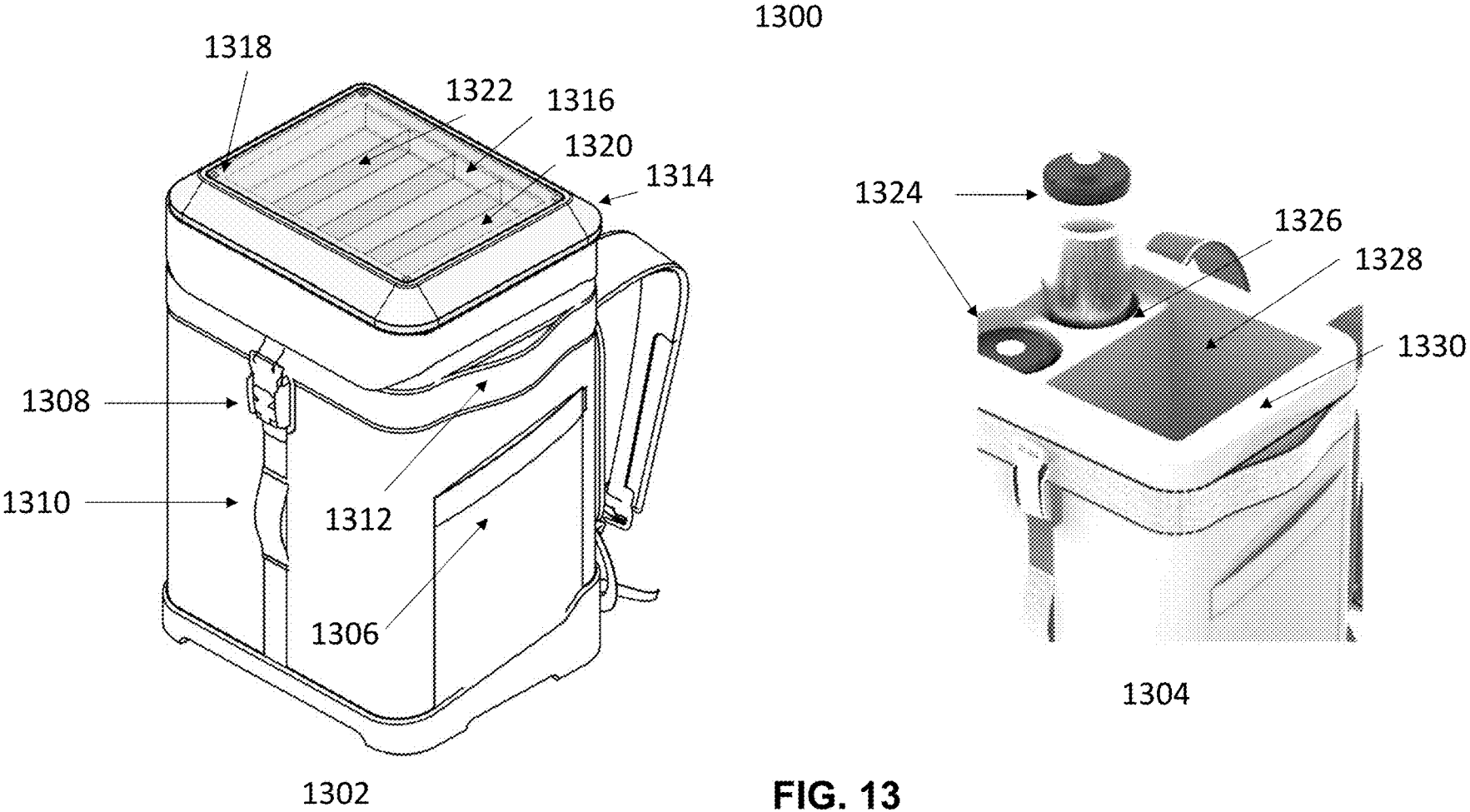
FIG. 13 illustrates several views of a soft-sided backpack style cooler and refillable container system incorporating teachings of the present disclosure.

As mentioned above, FIG. 13 illustrates several views of a soft-sided backpack style cooler and refillable container system 1300 incorporating teachings of the present disclosure. As shown, view 1302 shows a full view of system 1300 in a lid closed state. View 1304 depicts a partial view of system 1300 in an open lid state.

Referring to view 1302, several potential components of a system may be seen. An expandable pocket 1306 is visible as well as latch 1308, front handle 1310, and one of two side handles 1312. Handles like 1310 and 1312 may facilitate the carrying of system 1300, while latch 1308 may help ensure a secure closing of lid 1314. As depicted lid 1314 has a beveled edge around its perimeter on the top side. Lid 1314 may utilize a magnet closing mechanism along its bottom side. Also depicted, lid 1314 includes an incorporated and removable cutting board 1316, which has magnet connectors 1318 at each corner. In practice, magnet connectors 1318 may secure board 1316 in place while also allowing it to be removed, for example, to access storage bin 1320. As shown, bin 1320 includes removable and movable dividers 1322, which may allow a user to customize the layout of bin 1320. For example, a user may want four isolated spots within bin 1320 as is shown. In some cases, a user may want to store a paring knife, a bottle opener, a set of keys, a wallet a phone, etc. within bin 1320 and may need to adjust the locations of dividers 1322 to make that happen. In some embodiments, bin 1320 may include a charging component to allow a user to securely place a phone (for example) within bin 1320 and charge the phone while it is within bin 1320. Depending upon design concerns, the charging component could utilize solar power and a solar panel located on and/or removable or permanently attached to system 1300.

Referring now to view 1304, two tumblers 1324 are shown as being located within their own silos 1326. Additionally, a larger storage area 1328 is depicted. As shown, an insulating layer 1330 can be seen between an outer surface of system 1300 and the interior area 1328 and silos 1326. In practice, a user may store ice, cans, food, additional tumblers, etc. within storage area 1328. As depicted a user may need to open lid 1314 to gain access to storage area 1328 and anything located within storage area 1318. Conversely, if one or both of tumblers 1324 make use of a tap cap system, a user may be able to access the contents of the tumblers from outside cooler system at a dispensing region (like region 1222) without opening lid 1314. In practice, this may allow any ice or other things stored inside cooler system 1300 to remain cold and/or frozen for longer periods of time, because the opening and closing of a cooler lid is what causes the most melting of ice stored inside.

Figure 14:
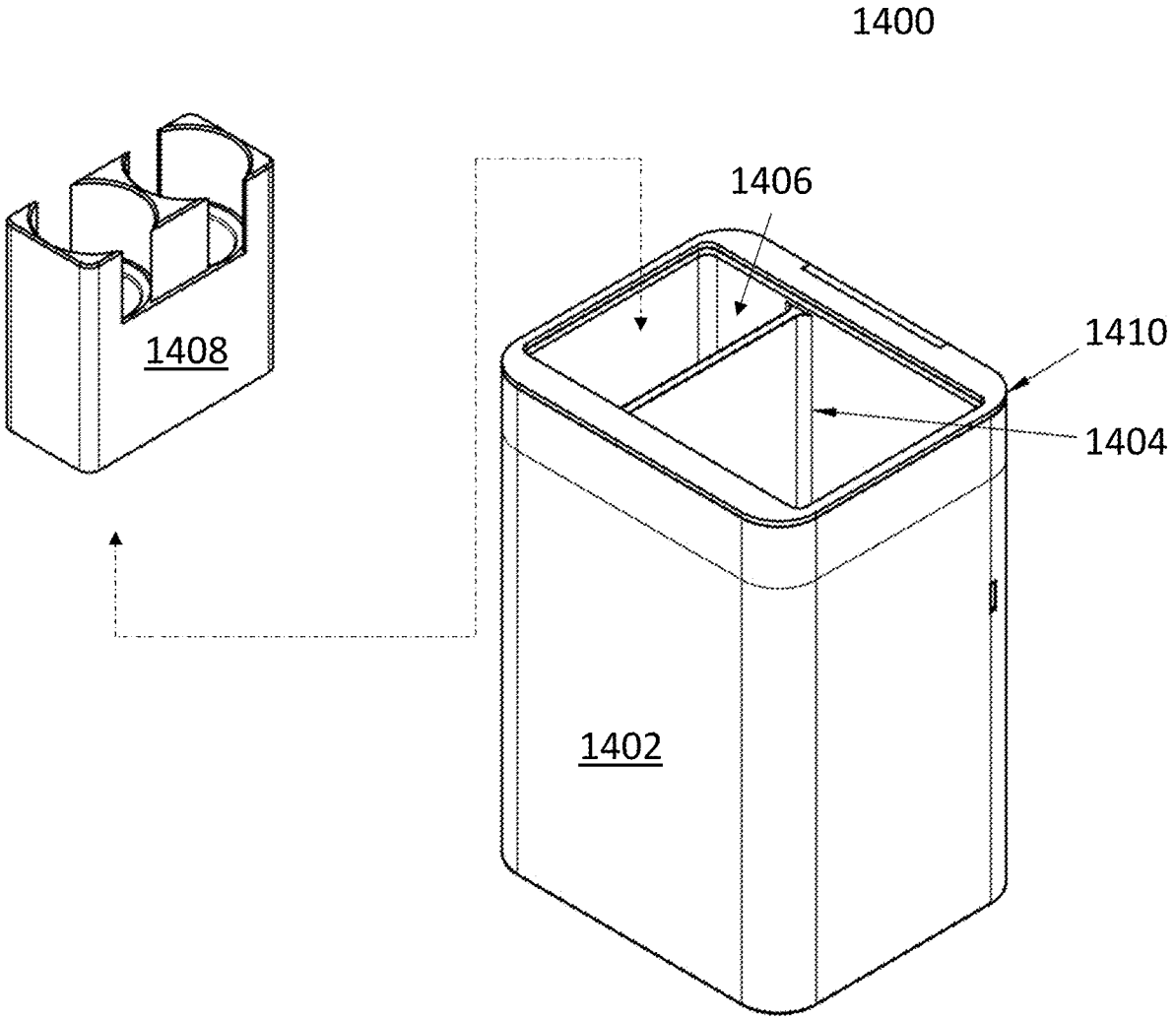
FIG. 14 illustrates components of a soft-sided backpack style cooler and refillable container system incorporating teachings of the present disclosure.

FIG. 14 illustrates components of a soft-sided backpack style cooler and refillable container system 1400 incorporating teachings of the present disclosure. Depending upon design concerns and manufacturability concerns, a designer may choose to manufacture a cooler system using multiple parts that may, for example, be inserted into a shell or other component during the manufacturing process. As shown, Insert 1402 may help define a storage area 1404 and a silo slot 1406. In practice, a silo system 1408 may be inserted into slot 1406 as part of a manufacturing process. Also depicted is magnetic closing surface 1410. In practice, surface 1410 may facilitate the use of a magnetic closing lid design. As indicated, silo system 1408 may be inserted into silo slot 1406, and insert 1402 may be inserted into a cooler shell, all during some manufacturing process. To facilitate these inserting operations, for potential cosmetic reasons, and/or for other reasons, silo system 1408 and insert 1402 are depicted as having rounded corners.

Figure 15:
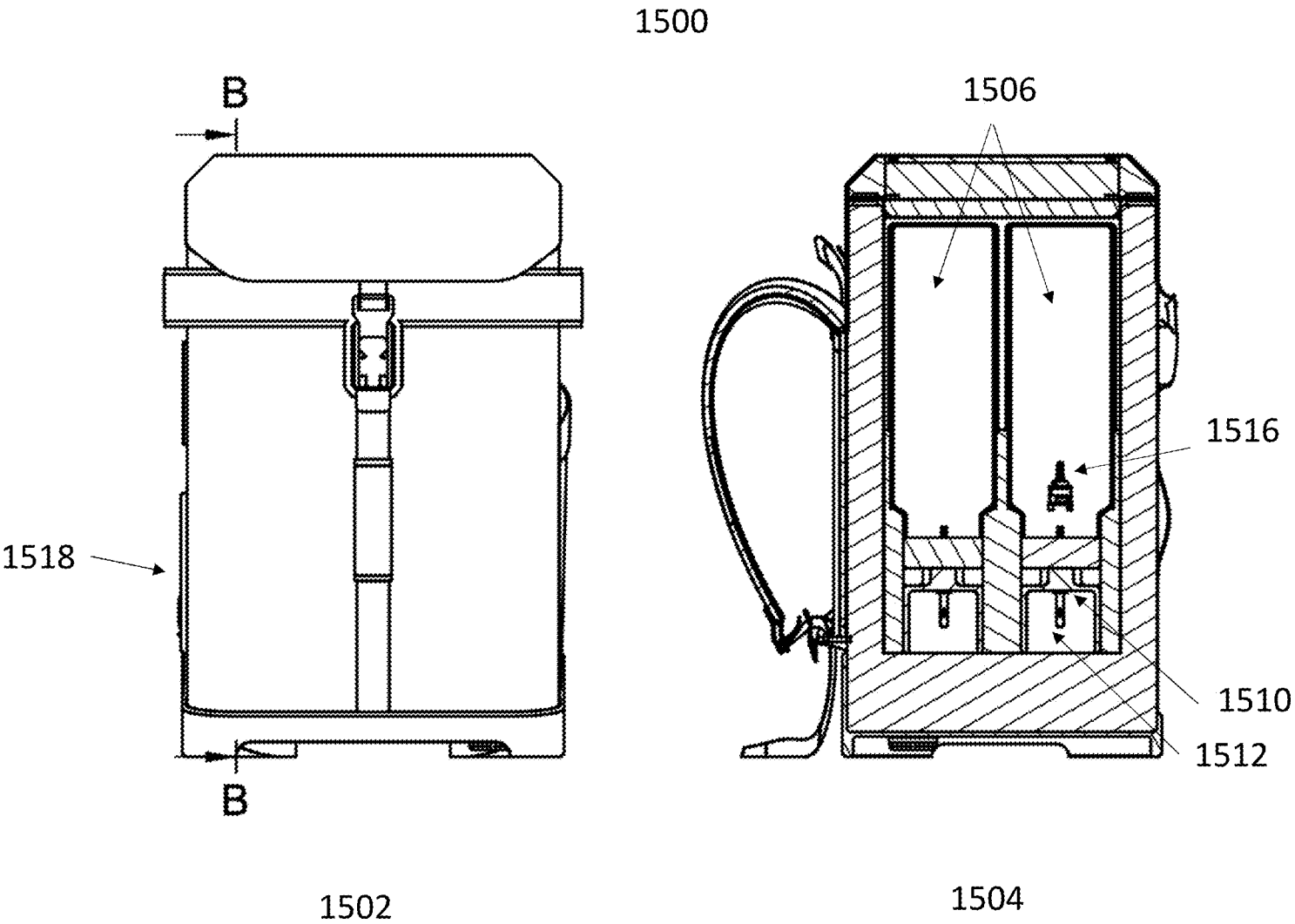
FIG. 15 illustrates a front view and a cross sectional side view of a soft-sided backpack style cooler and refillable container system incorporating teachings of the present disclosure.
Figure 16:
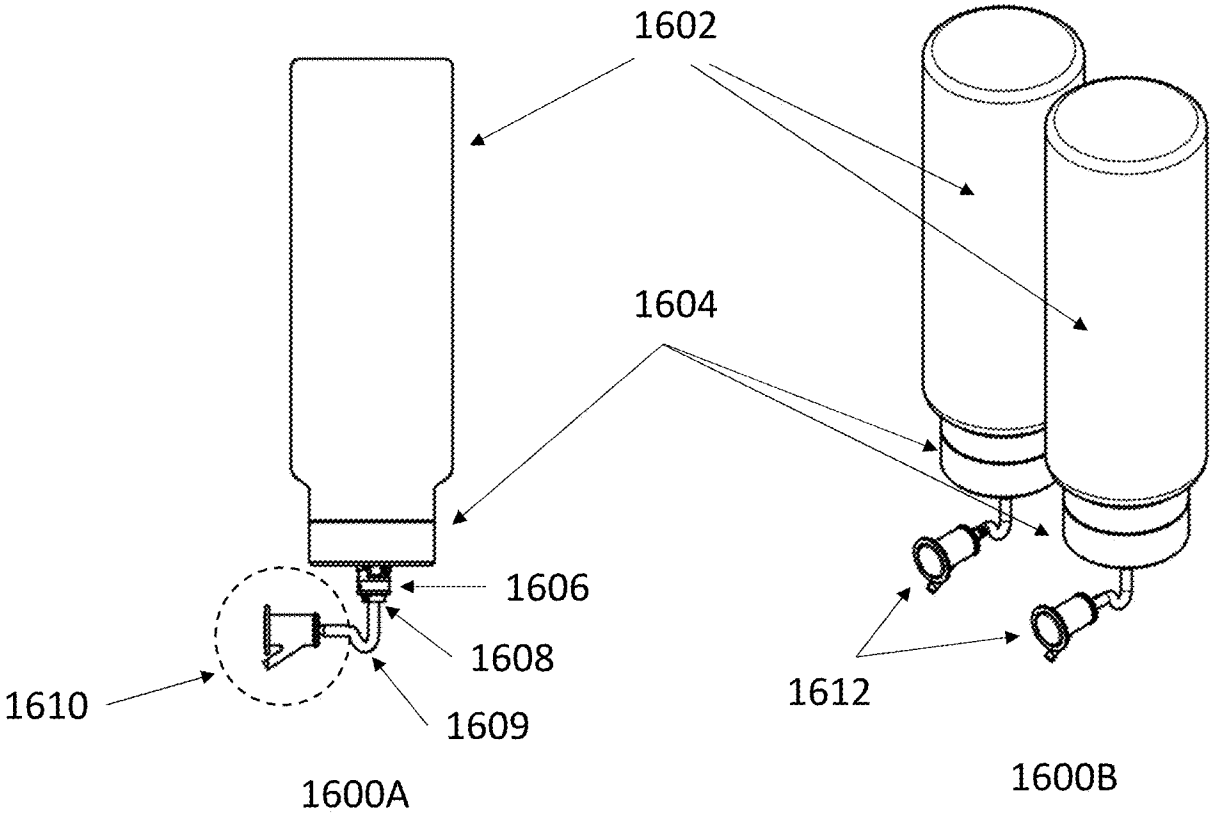
FIG. 16 illustrates beverage containers and tap cap components of a soft-sided backpack style cooler incorporating teachings of the present disclosure.

As mentioned above, FIG. 15 illustrates a front view 1502 and a cross sectional side view 1504 (with the cross section formed at surface "B") of a soft-sided backpack style cooler and refillable container system 1500 incorporating teachings of the present disclosure. As depicted, system 1500 provides a cut away view 1504 of two beverage sleeves, formed as two silos 1506, each designed to accept and maintain an insulated tumbler that may be storing a beverage. As depicted, silos 1506 are located inside. Also on the inside are mating plugs 1510 and tubes 1512. In practice, a user may remove a lid from an insulated tumbler and replace it with a tap cap lid, described more fully in connection with FIG. 17. The tumbler with a tap cap lid may be inverted and inserted into one of silos 1506 to mate with one of mating plugs 1510. The tap cap lid may include an adapter plug 1516 (shown without the tap cap lid or tumbler). The beverage inside the tumbler may then be able to pass through the adapter plug 1516 of the tap cap lid, through a hole within mating plug 1510 and into tube 1512, which is connected to plug 1510. Tube 1512 may be routed to and/or through a port to a dispensing region like region 1222, which may allow the beverage inside the tumbler to makes its way from the inside of a container to a dispensing port (like dispensing port 1610), which may be located on or near an outside wall surface 1518. Depending upon designer concerns, the dispensing port may be controlled by any number of devices. As shown in FIG. 16, dispensing port 1610 includes a push-button operated stopcock or spigot 1612. One of skill in the art may choose other mechanisms such as a lever, etc.

As shown in system 500, a container like container 100 that incorporates the elements of system 200 may allow a user to open a bottle of wine, pour the bottle into a tumbler, and access the wine using a dispensing mechanism (the ones depicted in several disclosed embodiments use gravity, but various pressuring mechanisms and/or other methods could be used), once the tumbler is inside the cooler, a user may close the cooler, and enjoy the wine without having to reopen the cooler.

As mentioned above, FIG. 16 illustrates beverage containers 1602 and tap cap lids 1604 of a soft-sided backpack style cooler incorporating teachings of the present disclosure. As shown, a designer may choose a single silo/tumbler implementation (shown at 1600A), a dual silo/tumbler implementation (shown at 1600B), or other combinations. Depending on design concerns (such as cooler dimensions and weight) a designer may have anywhere from one silo to ten silos, or more. In addition, a designer may elect to have one or more 32 oz tumblers, 40 oz tumblers, 64 oz tumblers, one-gallon tumblers, etc. In fact, a designer may choose to have an array of tumbler/silo configurations in the same cooler. In some embodiments, a designer may have two 64 oz tumbler/silo configurations and also provider an insert or adapter to allow a user to easily use a smaller tumbler (e.g., a 40 oz tumbler) in one or more of the 64 oz tumbler/silo configurations. Additionally, the tumblers could be double walled stainless tumblers, single walled, made from plastic, etc. The tumblers, the silo implementation, and various components of the system, could be food grade and able to withstand liquid temperatures from freezing to boiling.

As depicted, tap caps 1604 may include an adapter plug 1606 incorporated into lids 1604 that may thread onto tumblers 1602. In practice, a user may have a tumbler like tumbler 1602 with a different lid. For example, the lid may be one with an incorporated straw. It could also be a lid that merely seals the tumbler and keeps it from leaking. Whatever its configuration, a user may fill tumbler 1602 with a desired cocktail or beverage and screw on a lid. At some point, the user may elect to take off one lid and replace it with lid 1604. At that point, a user may elect to invert the tumbler and insert it into a silo that allows adapter plug 1606 to contact and removably connect with a mating plug 1608. In some embodiments, a connection between adapter plug 1606 and mating plug 1608 may be secured to minimize and/or eliminate leaking at the connection with a quarter turn seating. Once secured, liquid within tumbler 1602 may pass through adapter plug 1606 and mating plug 1608 and into tube 1609 that leads to dispensing port 1610. In the depicted embodiment, dispensing port 1610 utilizes a push-button operated spigot 1612. Depending on design concerns, a hole formed through the sidewall of a cooler may allow the combination of a tube and a push-button spigot (for example) to pass through the hole to allow liquid in a tumbler within the cooler to be dispensed outside the cooler.

For example, the tube may pass through the hole, the spigot may pass through the hole, some portion of both, etc.

Figure 17:
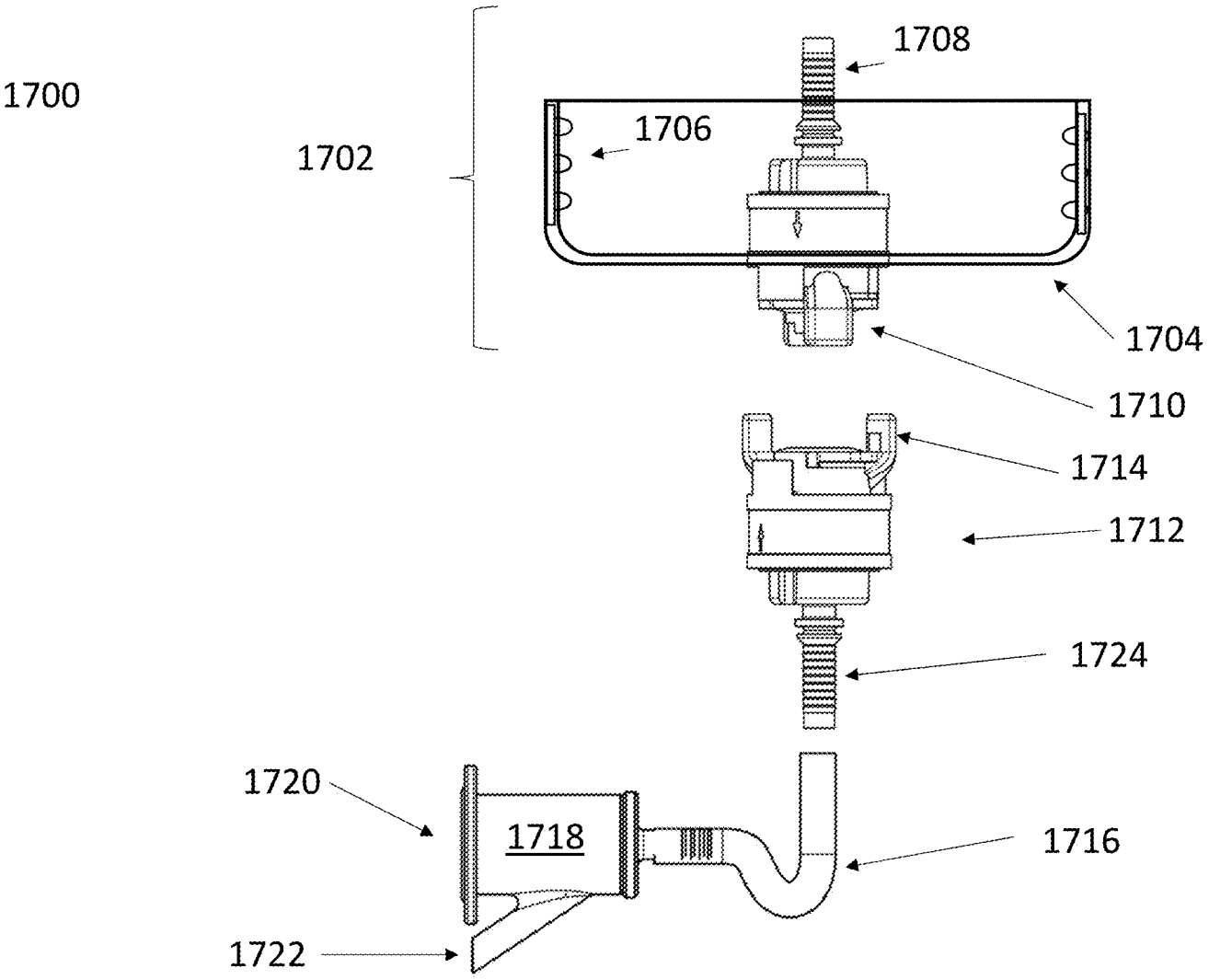
FIG. 17 illustrates an exploded view of tap cap components of a soft-sided backpack style cooler incorporating teachings of the present disclosure.

FIG. 17 illustrates an exploded view of tap cap system 1700 of a soft-sided backpack style cooler incorporating teachings of the present disclosure. As shown, tap cap 1702 includes a tumbler lid 1704 with threads 1706 and an integrated adapter plug 1708. As shown, adapter plug 1708 includes locking shoulders 1710 and a hole formed through the entirety of plug 1708 to allow liquids stored within a tumbler to which cap 1702 is attached to pass through plug 1708 and out of the tumbler. In practice, adapter plug 1708 may be designed to removably connect with mating plug 1712, which has its own locking shoulders 1714. In the depicted embodiment, locking shoulders 1710 and 1714 are configured to interact with one another and to create a leak proof and removable connection with a quarter turn of the tap cap. In the depicted embodiment, mating plug 1712 is secured within a silo of a cooler and effectively locked in place, and as such, it will be the tumbler and tap cap that are rotated to create the connection.

In addition to creating a leak proof and removable connection, the quarter turn locking also opens a valve within adapter plug 1708 (and potentially the mating plug as well). In practice, adapter plug 1708 includes a valve that remains closed until plugs 1708 and 1712 are mated. By remaining closed until the plugs are connected, the valve allows a tumbler with tap cap 1702 attached and filled with liquid to be inverted without leaking. In practice, a user may fill the tumbler with a drink, attach tap cap 1702, and invert the tumbler into the silo . . . all without spilling the contents of the tumbler. The tumbler may not begin to drain and pass its contents along until the valve of adapter plug 1708 is opened during the quarter turn seating operation with mating plug 1712.

Once seated, a liquid within the tumbler may pass through adapter plug 1708 and mating plug 1712 and into tube 1716. Additionally, dispensing port or mechanism 1718 may also control the flow of liquid from with a tumbler and into a cup. Operationally in the depicted embodiment, depressing a push button 1720 may open port 1718 and allow liquid to flow out of the spigot opening 1722. Similarly, releasing push button 1720 may close port 1718 and effectively stop liquid from flowing out of spigot opening 1722.

As shown, the embodiment of system 1700 has several independent components that work together to form system 1700. During a manufacturing process, components may need to be connected, and as such, many components may make use of a barbed connection portion 1724 that facilitate the leak proof connecting of a tube, like tube 1716, to component parts, like mating plug 1724.

As mentioned above, FIG. 18 illustrates a system 1800 with a beverage container 1802 and installed tap cap components 1804 incorporating teachings of the present disclosure. Container 1802, which may be a 40 oz double-walled stainless tumbler, has a tap cap 1804 threaded onto it to form a leak proof and removable connection. As shown, FIG. 18 includes a front view 1800A and a top view 1800B. Hopefully, the views help communicate some of the details of the depicted embodiment. As shown, tap cap 1804 includes threads 1806 that allow for an easy attaching and removing from tumbler 1802 in a manner that creates a leak proof connection when attached. Tap cap 1804 also includes adapter plug 1808 that is depicted in this embodiment as an irremovable part of tap cap 1804. In top view 1800B, valve 1810 is recognizable in the center of adapter plug 1808. A designer may choose to eschew the use of a valve, locate it in different places, alter the size of it, etc., all without departing from the teachings of this disclosure.

In practice, valve 1810 may be a spring-loaded stop valve with one or more components providing a spring force to keep the valve closed when the adapter plug is not fully seated to a corresponding mating plug. In some embodiments, adapter plug 1808 may utilize an actual coiled spring to provide the spring force that keeps valve 1810 closed.

As mentioned above, FIG. 19 illustrates a beverage container 1902 and various lids 1904, 1906, and 1908, of a soft-sided backpack style cooler system incorporating teachings of the present disclosure. As depicted container 1902 may be a double-walled stainless tumbler configured to hole at least 32 ounces of liquid. Coupled to container 1902 is a lid or cap 1904. As shown, lid 1904 may be secured to a container like container 1902 using a threads 1910, and lid 1904 may have an adapter plug 1912 incorporated into a center portion of lid 1904. When threaded onto container 1902, lid 1904 may keep any liquids within container 1902 from leaking. Moreover, adapter plug 1912 may allow container 1902 to be inverted without allowing any liquid to be passed through adapter plug 1912 unless adapter plug 1912 is secured to a mating plug. In practice, the mating of adapter plug 1912 with a mating plug may result in a sufficient pressure being applied to a spring-loaded valve incorporated into adapter plug 1912 by a portion of the mating plug. This pressure may cause a spring supplying pressure to the spring-loaded valve to be compressed enough to open the valve and to allow liquid to pass through plug 1912.

Figure 19:
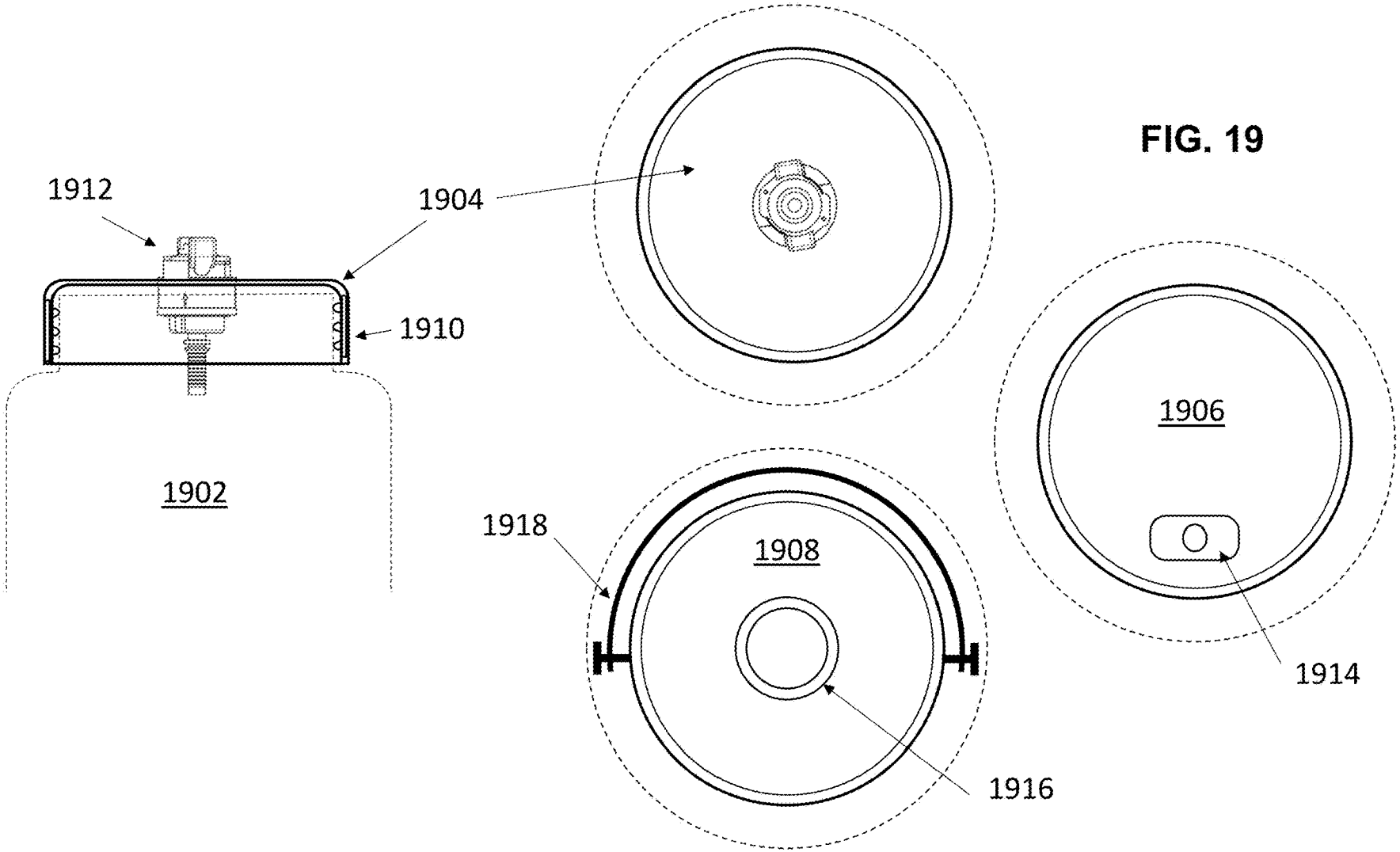
FIG. 19 illustrates a beverage container and various cap components of a soft-sided backpack style cooler incorporating teachings of the present disclosure.

Also depicted in FIG. 19 are lids 1906 and 1908. In practice, lids 1906 and 1908 may also include threads that would allow lids 1906 and 1908 to be threaded onto a container like container 1902. As such, a user of a container like container 1902 may have several different ways to configure container 1902. In one scenario, a user may elect to attach a tap cap like lid 1904 and use container 1902 as part of a cooler/drink distribution system described herein. Similarly, the user may also elect to remove lid 1904 and secure lid 1906 onto container 1902. As shown, lid 1906 includes an incorporated straw 1914. With lid 1906, a user may choose to carry container 1902 around and drink directly from it using straw 1914. In other scenarios, a user may attach lid 1908. As depicted, lid 1908 includes a large pouring spout 1916 and a carrying strap 1918. Strap 1918 may make it easier for the user to carry container 1902 around, and pouring spot 1916 may make it easier for a user to empty out the contents of container 1902.

As mentioned above, FIG. 20 illustrates components of a soft-sided backpack style cooler and refillable container system 2000 incorporating teachings of the present disclosure. As shown, a backpack-style cooler 2002 may include a top 2004, a bottom 2006, sidewalls 2008, and a latch 2010 that helps to secure top 2004 in a closed position. Within cooler 2002 may be several storage areas including at least one silo for accepting a tumbler. At the bottom of the silo may be a mating plug secured within the silo and connected through a tube to push-button spigot accessible on an exterior surface of cooler 2002 at or near dispensing area 2012. In practice, the push button spigot may be located such that a user has enough room to insert a cup with a height of over four inches under a spigot opening prior to depressing the push button.

Figure 20:
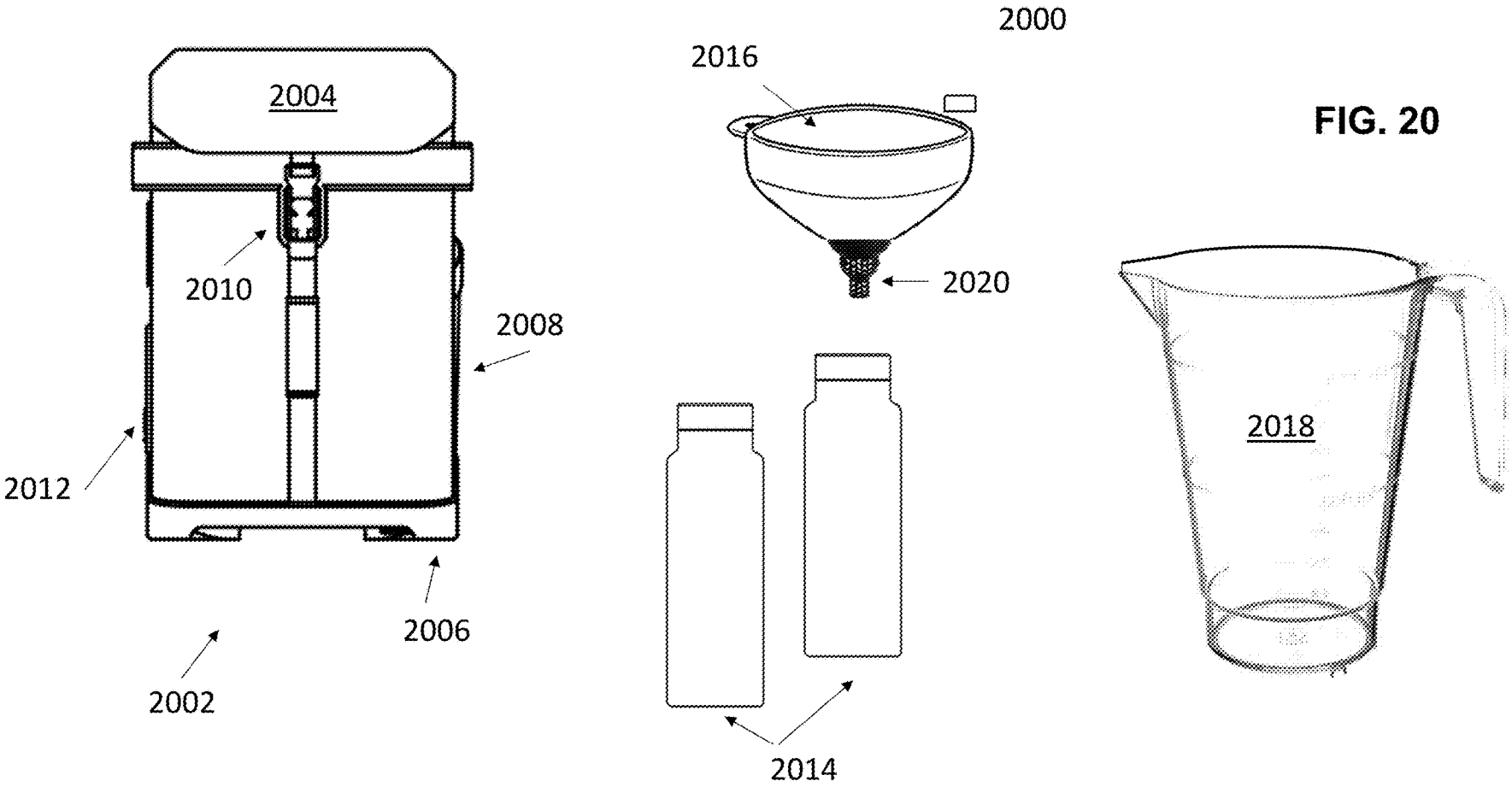
FIG. 20 illustrates components of a soft-sided backpack style cooler and refillable container system incorporating teachings of the present disclosure.

Also depicted in FIG. 20 are tumblers 2014, filtering funnel 2016, and mixing pitcher 2018. In operation, a user may take pitcher 2018 and add a cocktail mix, which could be a syrup, a powdered mix, or some other form or combination of mixes, to pitcher 2018. The user may then add a combination of other liquids such as a quantity of tequila, a quantity of orange liqueur, etc. to pitcher 2018. The user could also use one or more of water, milk, vodka, gin, various combinations of liquids, etc. At some point, a user may have completed a creating of a drink in pitcher 2018. For example, a user may want to make a pitcher of margaritas. The user may add 750 ml of tequila, 750 ml of orange liqueur, 500 ml of water, and a 250 ml bottle of margarita cocktail syrup to pitcher 2018. At that point, the user may have 2250 ml (or just under 80 oz) of premade margaritas in pitcher 2018.

Utilizing filtering funnel 2016, the user may pout approximately 40 oz into each of the two tumblers 2014. At this point, the user would have two ready-to-go margarita batches prepared and loaded into tumblers 2014. If the user then attached tap caps like lid 1904 to the tumblers, the user could invert and load tumblers 2014 into cooler 2002, and others would be able to dispense the margarita mixture into cups using a push-button spigot near dispensing area 2012 without reopening cooler 2002. Such an embodiment could help keep any ice within cooler 2002 from melting and effectively allow cooler 2002 to become a portable drink station.

In practice, filtering funnel 2016 may be a collapsible funnel made of silicone with a filtering system 2020 formed into the bottom of the funnel. Such an embodiment could allow a user to ensure that seeds, contaminants, or other things over a certain size do not make it into a container like tumblers 2014 and ultimately into an adapter plug (like plug 1516) of a tap cap lid, a mating plug (like plug 1510), a tube (like tube 1512), which may be routed to and/or through a port to a dispensing area like region 2012, or through a spigot opening. Depending upon designer concerns, various screening options can be incorporated throughout the system to help ensure continued and effective operation.

As mentioned above, FIG. 21 illustrates a close up view of various components of a cooler and refillable container system 2100 incorporating teachings of the present disclosure. In the depicted embodiment, a silo wall 2102 is formed such that an insulated drink tumbler 2112 can be inverted and be removably inserted within the silo. Depending upon design concerns, the inside diameter of the silo and the exterior diameter of the tumbler 2112 may be within 0.25 inches. For example, tumbler 2112 may have an outside diameter of 4.0 inches while the silo might have an interior diameter of 4.25 inches. A designer may choose to have a closer fit to ensure tumbler 2112 is snugly in place when inserted. Similarly, a designer may elect to have a larger variance between the diameters, such as 0.5 inches or less, 1.0 inches or less, etc. In some embodiments, tumbler 2112 may be a 64 oz tumbler with a 4.0 inch diameter, and a user may want to use 40 oz tumbler with a 3.5 inch outside diameter. In such a case, a designer may also provide a sleeve, a spacer, or some other device to effectively accommodate the smaller tumbler inside the larger silo without too much movement or play.

Two components of a quick disconnect system may include a female component and a male component. Each may have an internal fluid channel that is capable of allowing liquid to flow through the two components when, for example, respective internal springs are compressed. This compression may occur when the two components are releasably coupled to one another. Internal to each component, the spring, or other biasing component, may provide a biasing force that presses a flow stopping surface against a seal, which can be O-ring seals, that may circumferentially surround a necking portion of the fluid channel. In some embodiments, components of the quick disconnect system may be generally circular and or cylindrical in shape.

In practice, annular seals may remain compressed between a flow stopping surface and necking portion of a fluid channel and resist liquid flow when the female and male components are disconnected. However, when being connected, end portions of the male and female components may touch and apply force against the internal springs and cause each of the flow stopping surfaces to recede against the force of the springs and open the closure between the two internal fluid channels.

As will be appreciated by one skilled in the art after reviewing this disclosure, the disconnection of the male and female components provides a nearly automatic and rapid seal by virtue of the springs, O-rings, and flow stopping surface. As such, release of liquid remaining in a tumbler is made much less likely when the tumbler's tap cap or lid having a quick disconnect capable adapter plug is disconnected from a quick disconnect capable mating plug within a silo.

To facilitate disconnection of two removably coupled components, a releasable lock assembly may be associated with the female portion and male portion. When a portion of the male component is inserted into a receiving portion of the female component, one or more latching members on the male component may align with one or more latching channels to securely hold and releasably lock the male component in a connected position with the female component.

As previously described, a system may incorporate a twist-to-lock and twist-to-unlock solution. Similarly, a system may include other lock/unlock solutions. For example, a designer may elect to use a quick-disconnect or quick-action solution with one or more locking balls and a slideable detent sleeve. Generally speaking, a cylindrical socket having a flow pathway may be configured to be attached to a generally cylindrical plug also having a flow pathway. The plug (or portion of the male component) may be inserted into the socket (or a portion of a female component) to create a single and opened flow pathway between the two components.

Generally speaking, a socket may have a plurality of evenly spaced locking balls contained in apertures arranged around the receiving end of the socket. A spring biased detent sleeve may circumscribe the socket and hold the locking balls radially inwardly. With some designs, the detent sleeve may be configured to retract upon the insertion of a plug into a socket. As such, a user may press a tumbler with a tap cap into a silo, which may cause the detent sleeve to move down longitudinally away from the plug receiving end of the socket. This movement may cause locking the balls to be released. In practice, the plug may have an annular groove, or race, for receiving the locking balls. When the locking balls "drop" into the annular groove, the locking sleeve may slide back into its starting position and effectively lock the male and female components together. The user may remove the tumbler in a similar fashion. In practice, a user may pinch accessible levers on the outside of the cooler, which may force a detent sleeve to again move down longitudinally away from the plug receiving end and "unlock" the locking balls from the annular groove of the male component. This unlocking may allow for the quick disconnection of the male and female components.

Additionally, a designer may choose to form the silo into a truly cylindrical shape. In other cases, a designer may choose a silo with a triangular cross section, a rectangular cross section, a pentagonal cross section, a hexagonal cross section, etc. In practice, anything beyond four sides may begin to look like a circular cross section and be effectively cylindrical.

Figure 21:
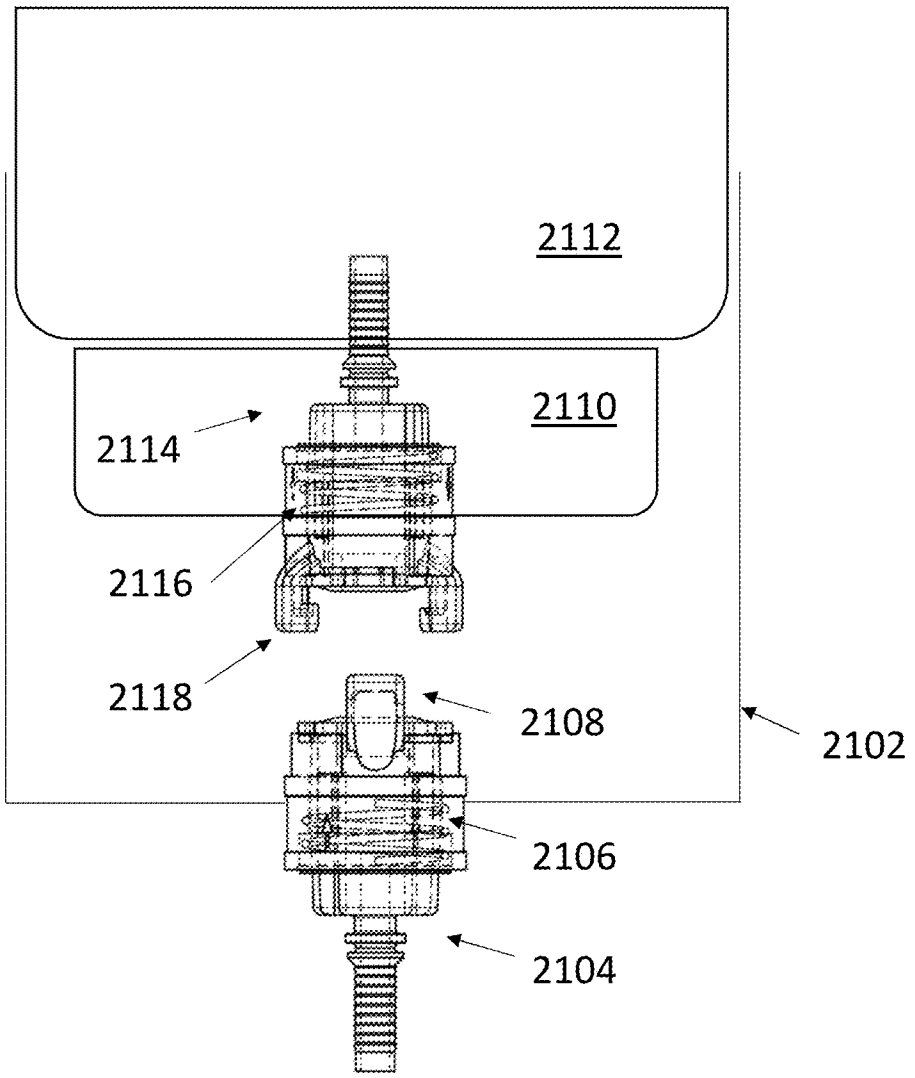
FIG. 21 illustrates a close up view of various components of a cooler and refillable container system incorporating teachings of the present disclosure.

In FIG. 21, a mating plug 2104 may be secured at the bottom of the silo. It may be located at the center of the bottom. Within mating plug 2104 may be a spring 2106 that operates a spring-loaded stop valve. In practice, the valve may be closed until the spring is compressed, which may occur when mating plug 2104 and adapter plug 2114 are brought together and seated to one another via, for example, a quarter turn locking move that cause locking shoulders 2108 and 2118 to engage one another.

As depicted, adapter plug 2114 may also include a spring-loaded valve 2116. Additionally, adapter plug 2114 may be formed into the center of lid 2110, which is threaded onto tumbler 2112. In operation, a user may pour, for example, a margarita cocktail into tumbler 2112 while at home. The user may carry the tumbler to a destination and decide it is time to drink and share the margarita. As such, the user may remove a lid from tumbler 2112 and thread on tap cap lid 2110. At that point, the user may invert tumbler 2112 and insert it within silo walls 2102. Because of valve 2116, the margaritas within tumbler 2112 will not spill when the tumbler is inverted. After inserting tumbler 2112 into the silo, the user may allow adapter plug 2114 to come into contact with mating plug 2104. At that point, a quarter turn of tumbler 2112 may cause locking shoulders 2118 and 2108 to engage with one another and adapter plug 2114 and mating plug 2104 to securely seat with one another. This process may also cause the releasing of both valve 2116 and the mating plug valve attached to spring 2106. At this point, the margaritas inside tumbler 2112 would be free to dispense through a tube, like tube 1609, when a dispensing mechanism is activated. For example, depressing a push button, like button 1720, may open a dispensing port, like port 1718, and allow the margaritas to flow out of a spigot opening, like opening 1722.

As mentioned above, FIG. 22 illustrates a cut away view of a system 2200 that includes various components of a cooler and refillable container system incorporating teachings of the present disclosure. As shown, a mating plug 2204 may be secured at the bottom of a cooler silo (silo walls depicted at 2202). It may be located at the center of the bottom. Within mating plug 2204 may be a spring 2206 that operates a spring-loaded stop valve. In practice, the valve may be closed until the spring is compressed, which may occur when mating plug 2204 and adapter plug 2214 are brought together and seated to one another via, for example, a locking ball(s) 2208 and locking channel 2209 assembly. The locking may occur when the locking balls 2208 "fall into" the channel 2209 and a locking sleeve 2218 is released into the position depicted.

As depicted, adapter plug 2214 may also include a spring-loaded valve 2216. Additionally, adapter plug 2214 may be formed into the center of lid 2210, which is threaded onto tumbler 2212. In operation, a user may pour, for example, a pot of coffee into tumbler 2212 while at home. The user may carry the tumbler to a destination and decide it is time to drink and share the coffee. As such, the user may remove a non-tap cap lid from tumbler 2212 and thread on tap cap lid 2210. At that point, the user may invert tumbler 2212 and insert it within silo walls 2202. Because of valve 2216, the coffee within tumbler 2212 will not spill when the tumbler is inverted. After inserting tumbler 2212 into the silo, the user may allow adapter plug 2214 to come into contact with mating plug 2204. At that point, a downward force applied to tumbler 2212 may cause locking sleeve 2218 to recede allowing locking balls 2208 to move radially outward and thus allowing adapter plug 2214 and mating plug 2204 to securely seat with one another. Once seated, locking sleeve 2218 may return to its depicted position and "lock" balls 2218 radially inward and into channel 2209. This process may also cause the releasing of both valve 2216 and the mating plug valve attached to spring 2206. At this point, the coffee inside tumbler 2212 would be available for dispensing through a tube, like tube 1716, when a dispensing mechanism is activated. For example, depressing a push button, like button 1720, may open a dispensing port, like port 1718, and allow the coffee to flow out of a spigot opening, like opening 1722. As will be understood by a designer, the tube, spigot, etc. may formed from materials that can handle a variety of temperatures. For example, hot coffee might be brewed at close to 210 degrees fahrenheit, and margaritas might be served at close to 32 degrees fahrenheit. As such, component materials could be selected from materials that can properly dispense liquids from near freezing to near boiling temperatures without degradation.

As mentioned above, FIG. 23 illustrates a tumbler lid component 2300 that may be a component of a dispensing system incorporating teachings of the present disclosure. As shown, lid 2300 may include an adapter plug 2302 that is threaded into or coupled in some way to a threaded lid component 2304. As shown, a flow channel 2306 may be formed through both threaded lid 2304 and plug 2302. As depicted, channel 2306 may have a locking valve component 2308 that can be spring loaded in a manner that pushes valve 2308 downward (in the depicted view) such that channel 2306 can be releasably sealed in a manner that disallows the free flow of liquid through channel 2306.

Figure 22:
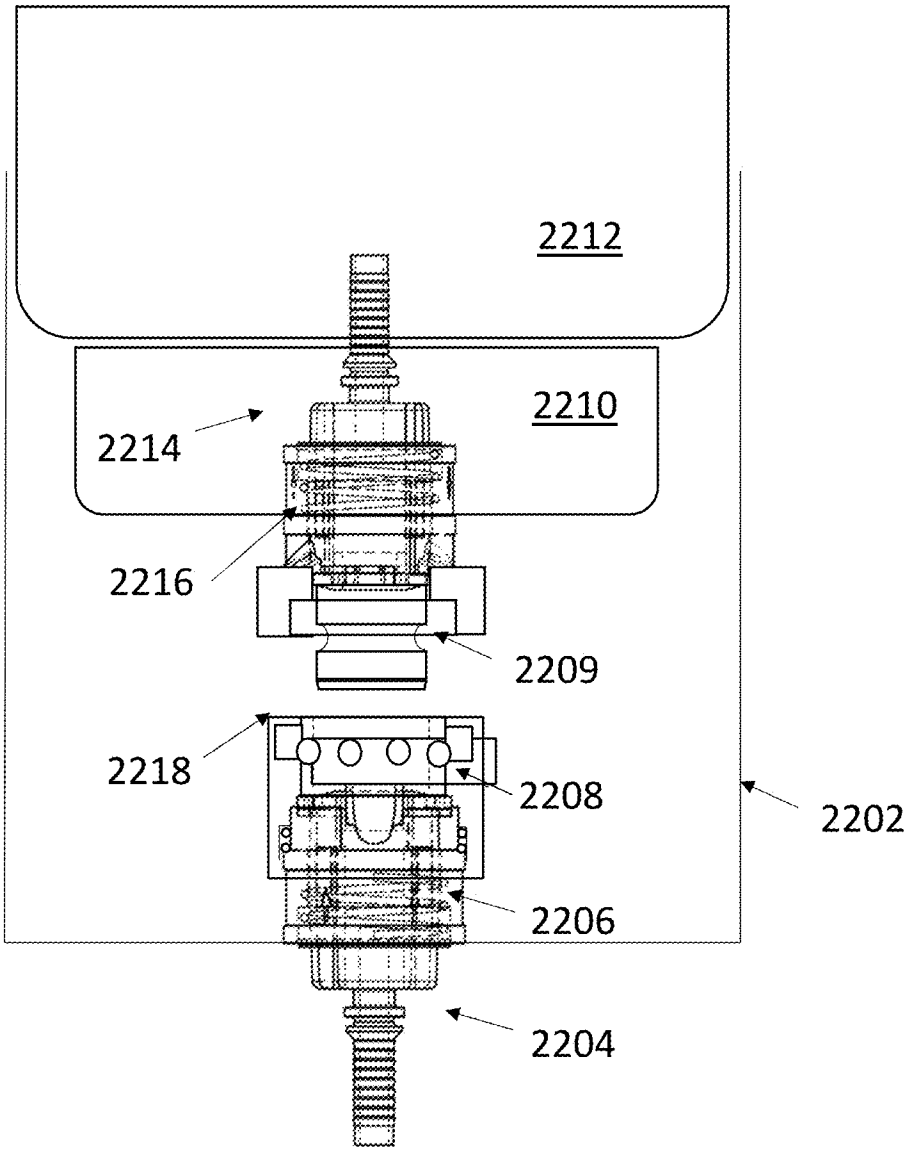
FIG. 22 illustrates a cut away view of various components of a cooler and refillable container system incorporating teachings of the present disclosure.
Figure 23:
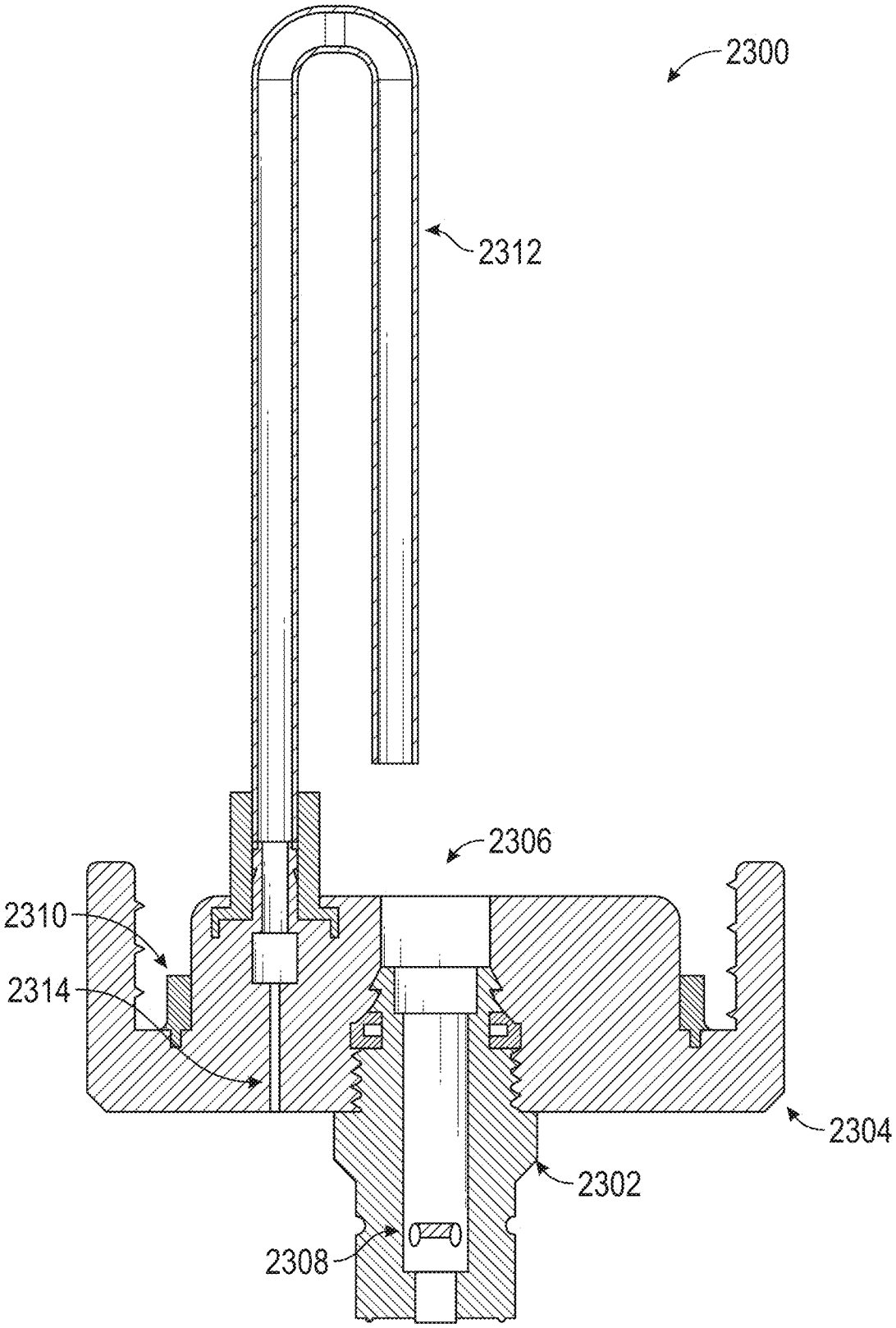
FIG. 23 illustrates a tumbler lid component of a dispensing system incorporating teachings of the present disclosure.

In practice, valve 2308 may be forced open when adapter plug 2302 is mated with a mating plug (like mating plug 2204) and the two plugs are releasably coupled to one another using a mechanism like the locking shoulders of FIG. 21, the locking balls and channel of FIG. 22, or some other locking mechanism. Also depicted in FIG. 23 is a sealing ring 2310. In practice, when lid 2300 is releasably threaded onto a tumbler, sealing ring 2310 may be compressed in a manner that creates an air tight or near air tight connection between the tumbler and lid 2300. As such, removing liquid from an inverted tumbler that is securely coupled to lid 2300 may be difficult, as a vacuum may be formed within the tumbler as the liquid tries to leave the tumbler.

At least in part, to assist in relieving a potential vacuum situation, breather tube 2312 may be included and attached to a breathing port 2314, which may be a hole formed through threaded lid 2304.

Figure 24:
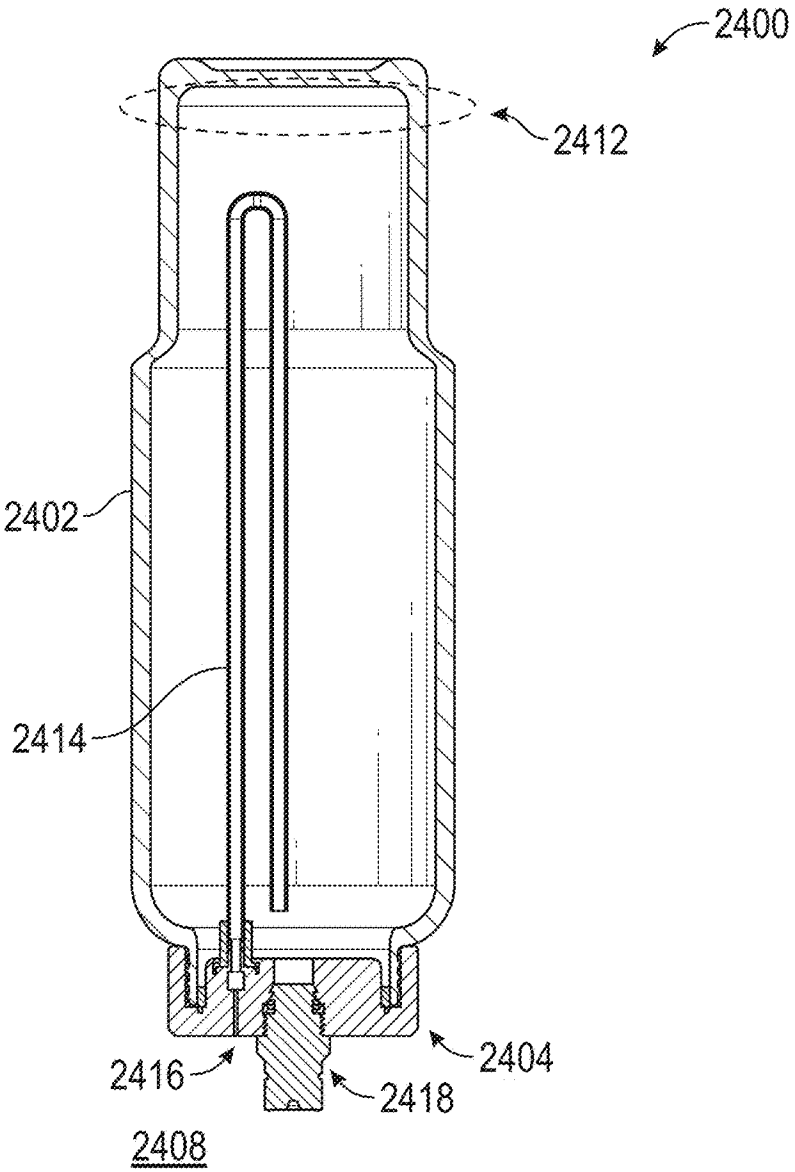
FIG. 24 illustrates a tumbler and lid combination in an upright and inverted position that incorporate teachings of the present disclosure.
Figure 24:
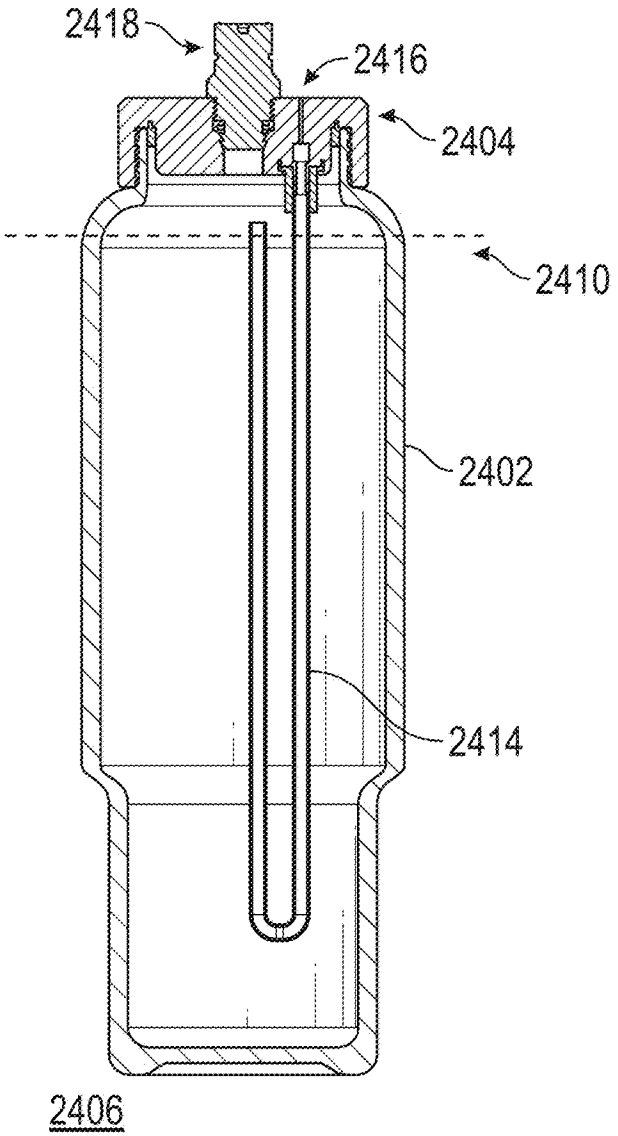

As mentioned above, FIG. 24 illustrates a system 2400 having a tumbler 2402 and lid 2404 combination in an upright position (view 2406) and an inverted position (view 2408) that incorporate teachings of the present disclosure. As shown, fill line 2410 in view 2406 may result in air pocket 2412 in view 2408. Similarly, a designer will recognize that breather tube 2414 may also be holding a pocket of air within tube 2414. When tumbler 2402 is inverted and goes from view 2406 to view 2408, some or all of the air within tube 2414 may be expelled by the liquid within tumbler 2402. This process may assist in forming additional vacuum pressure within tumbler 2402, and this vacuum pressure may facilitate a resistance to liquid leaking from tumbler 2402, through breather tube 2414 and out breather port 2416 when tumbler 2402 is placed into the inverted position of view 2408. As such, a user may be able to inverter tumbler 2402 without fear of the tumbler leaking. At the same, a user may be able to mate adapter plug 2418 with a mating plug, like plug 2204, that opens a flow channel, like channel 2306, to allow liquid within tumbler 2402 to be dispensed. Once mated, breather tube 2414 and breather port 2416 may act to release vacuum pressure within tumbler 2402 and to allow for the flowing of liquid out of tumbler 2402 and through a channel, like channel 2306.

Figure 25:
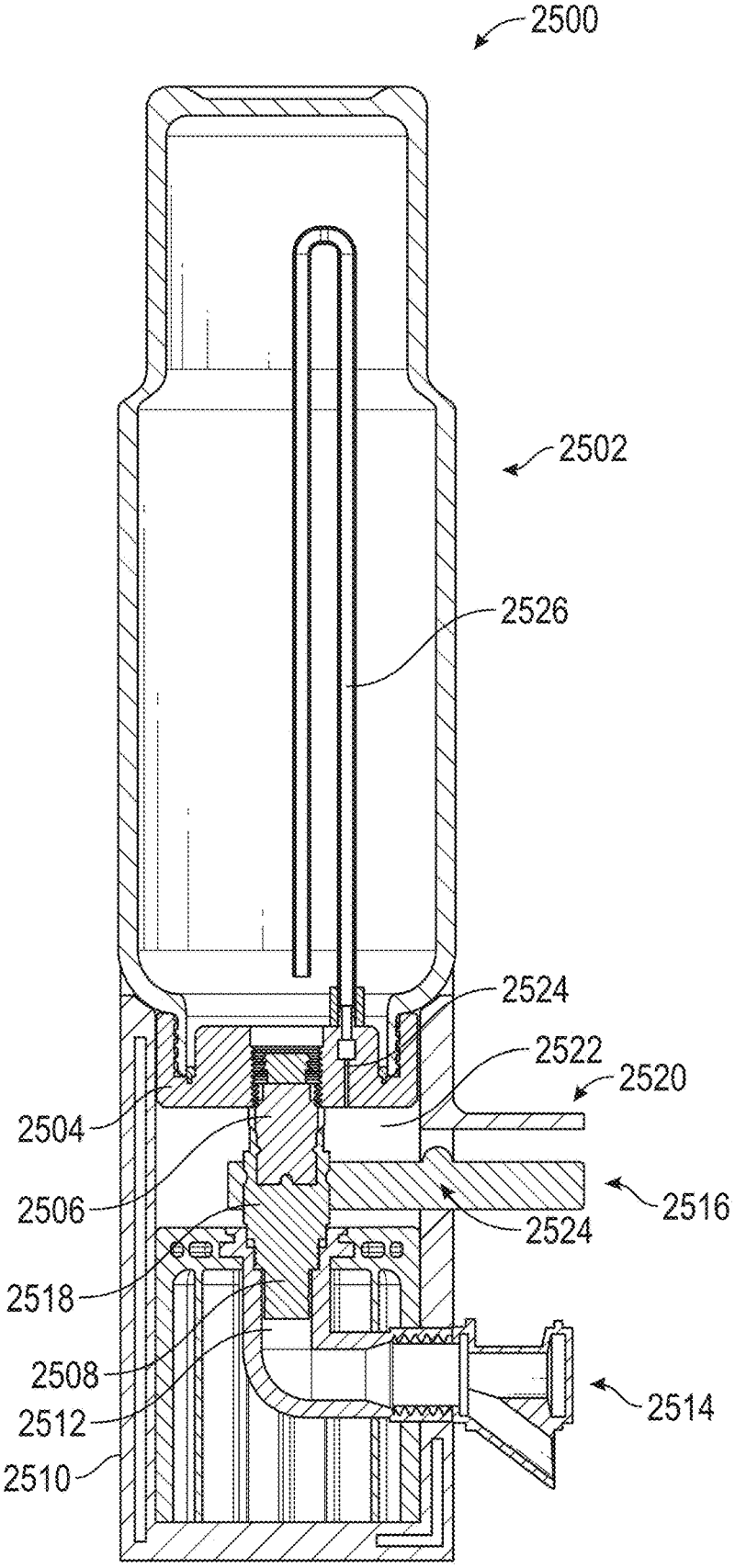
FIG. 25 illustrates cut away views of a container with a cap incorporating teachings of the present disclosure.

As mentioned above, FIG. 25 illustrates cut away view of a system 2500 that includes a container 2502 with a cap system 2504 that incorporate teachings of the present disclosure. As depicted, container 2502 may be a tumbler, for example an approximately 40 oz (40+/−5 oz) double walled, insulated, stainless steel tumbler, an approximately 64 oz (64+/−10 oz) double walled, insulated tumbler, an approximately 128 oz (128+/−30 oz) double walled, insulated tumbler, a glass wine bottle, an aluminum can, and/or some other size and type of container.

As depicted, container 2502 may have a cap system 2504 removably threaded onto container 2502, and cap system 2504 may include an adapter plug 2506, a breathing port 2524 and a breathing tube 2526. As shown, adapter plug 2506 is releasably coupled to mating plug 2508, which is secured within an injection molded housing component 2510, which may be located near the bottom of a cooler that includes a system like system 2500.

Also secured within housing component 2510 may be a tube element 2512 that is connected between a mating plug 2508 and spigot 2514. As depicted, tube 2512 may be rigid or semi rigid. It could also be flexible. As shown, tube 2512 may be configured to avoid the creation of a low spot in the fluid flow path between container 2502 and spigot 2514. In such a design, the likelihood of remnant liquid pooling within system 2500 may be minimized.

Also shown in system 2500 is releasing arm 2516. In practice, releasing arm 2516 may extend through the sidewall of a cooler to be accessible to a user without the need to open the cooler. Similarly, spigot 2514 may extend to the outside of a cooler to allow a user to dispense liquids from within container 2502 without opening the cooler, even though container 2502 may be secured inside the cooler.

In operation, a user may have seated container 2502 into its depicted position by providing a downward force on container 2502 that caused adapter plug 2506 to securely and removably couple with mating plug 2508. To release container 2502 and effectuate a quick disconnect between adapter plug 2506 and mating plug 2508, a user may pinch releasing arm 2516 upward toward leverage tab 2520, which may be formed as a component of housing component 2510. In practice, pinching releasing arm 2516 upward toward leverage tab 2520 may cause releasing arm 2516 to pivot around fulcrum 2524. This process may result in the exterior portion of releasing arm 2516 moving upward toward leverage tab 2520 and the interior portion of releasing arm 2516 to move downward. As depicted, the interior portion of leverage arm 2516 wraps around a locking sleeve 2518 of mating plug 2508. As such, the downward pavement of the interior portion causes locking sleeve 2518 to be pulled downward as well. As shown in FIG. 22, the movement of a locking sleeve, like sleeve 2218, in a downward fashion may release locking balls, like locking balls 2208, from the locking channel of an adapter plug, like locking channel 2209. This operation may result in the releasing of container 2502 such that it may be removed from a silo and a cooler.

As depicted, container 2502 is still connected and may release liquids for dispensing from spigot 2514 when spigot 2514 is activated. For example, spigot 2514 may have a push button operation that opens the spigot and allows liquid to drain from container 2502, through valves 2506 and 2508, through tube 2512, and out spigot 2514. As mentioned above, a container like container 2502 may be inclined to facilitate the creation of a vacuum with the container. To alleviate vacuum pressure, breather port 2524 may be formed through cap 2504 and a breathing tube 2526 may be connected to port 2524. As such, a designer may elect to form the bottom of a silo configured to receive a container like container 2502 in a manner that creates a void 2522 in a housing component like component 2510. A void like void 2522 may allow for the free flow of air from outside the cooler and into breathing port 2522.

Figure 26:
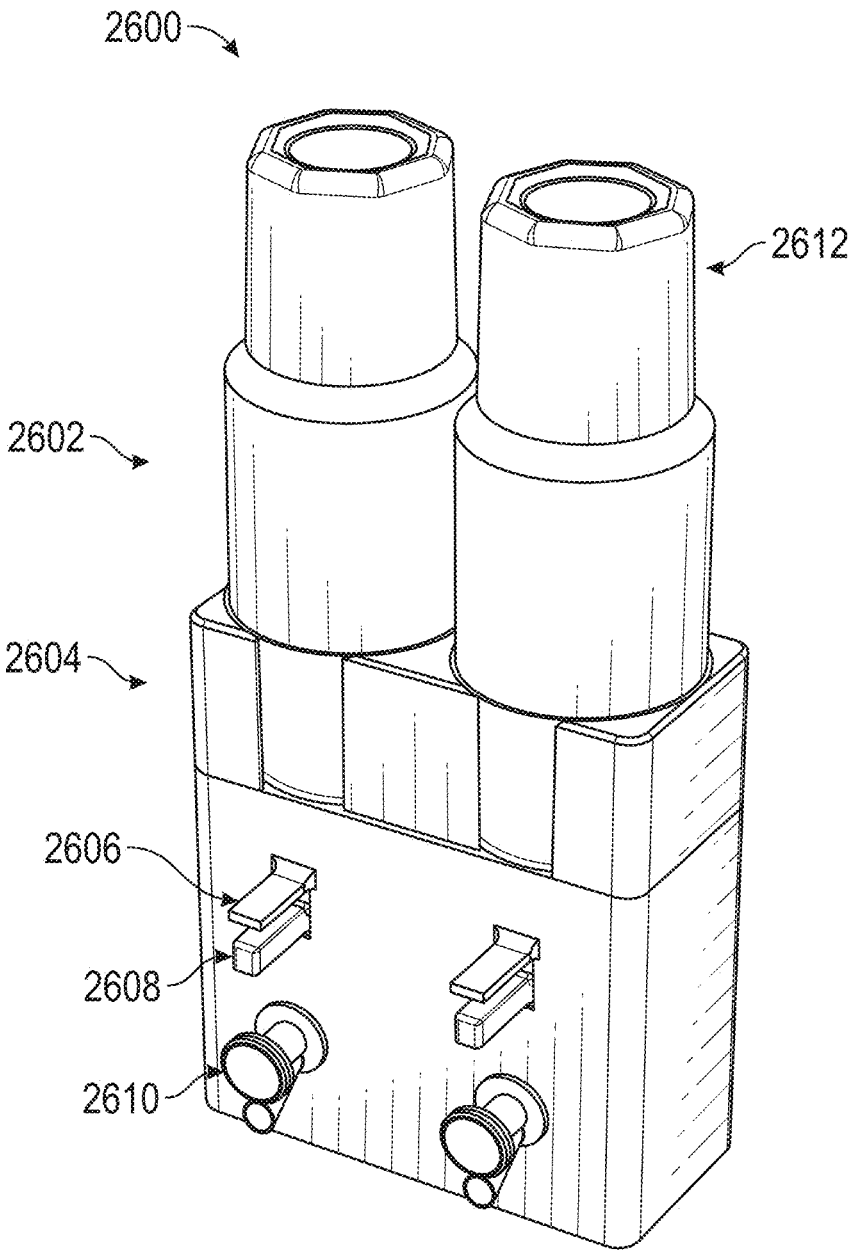
FIG. 26 illustrates a pair of removably coupled tumblers with a dispensing system that incorporate teachings of the present disclosure.

As mentioned above, FIG. 26 illustrates an exterior view of a potential two spigot subsystem 2600 that may be included within a cooler configured with internal silos designed to receive tumblers like tumblers 2602. As depicted, system 2600 includes a pair of removably coupled tumblers 2602 with a dispensing system housing component 2604 that incorporate teachings of the present disclosure. Also shown are examples of potential leverage tabs 2606, exterior portions of releasing arms 2608, and a pair of spigots 2610. Operationally, system 2600 may perform in a manner similar to that described in connection with FIG. 25. Though system 2600 includes a two-tumbler design, similar systems could involve a one tumbler design, a three-tumbler design, a four-tumbler design, etc. Moreover, the containers used in a system like system 2600 could be tumblers, bottles, cans, reservoirs of various configurations and materials, etc.

As depicted, tumblers 2602 may be approximately 40 oz tumblers with a generally cylindrical body that tapers into a narrower and octagonally shaped base portion 2612 (the tumblers are depicted in an inverted orientation). The tapering may allow a tumbler like tumbler 2602 to fit within a vehicle cup holder. The polygonal cross section of the bases 2612 may facilitate the grabbing and removing of tumblers 2602 from silos.

As mentioned above, FIG. 27 illustrates a side view 2702 and a top view 2704 of a four-tumbler carrying component 2700 that incorporates teachings of the present disclosure. As depicted in view 2702, carrying component 2700 may have a height dimension "X". Depending upon design concerns, X could be between 12 and 13 inches. In other embodiments, X could be larger or smaller. As depicted in view 2702, carrying component 2700 may be designed to carry tumblers like tumblers 2706. The depicted embodiment may be designed to carry four tumblers, but other carrying capacities may be desired. For example, a carrier could carry two tumblers to six tumblers to twelve tumblers.

As shown, carrying component 2700 may include a handle 2708, which may include finger cut outs if so desired. Also, carrying component 2700 may include a platform 2710, which may have cut out portions 2712 for receiving a bottom portion of a tapered tumbler. As depicted, cut outs 2712 have a generally octagonal shape and may have a diameter of approximately 2.75 to 3.25 inches. As shown, carrying component 2700 has a generally square platform 2710 with side length dimensions of "Y". Depending upon design concerns, the dimension Y may be between 5 and 5.5 inches. The dimension Y could be smaller or larger depending upon design concerns, the size of tumblers being carried, the number of tumblers being carried, etc.

Figure 27:
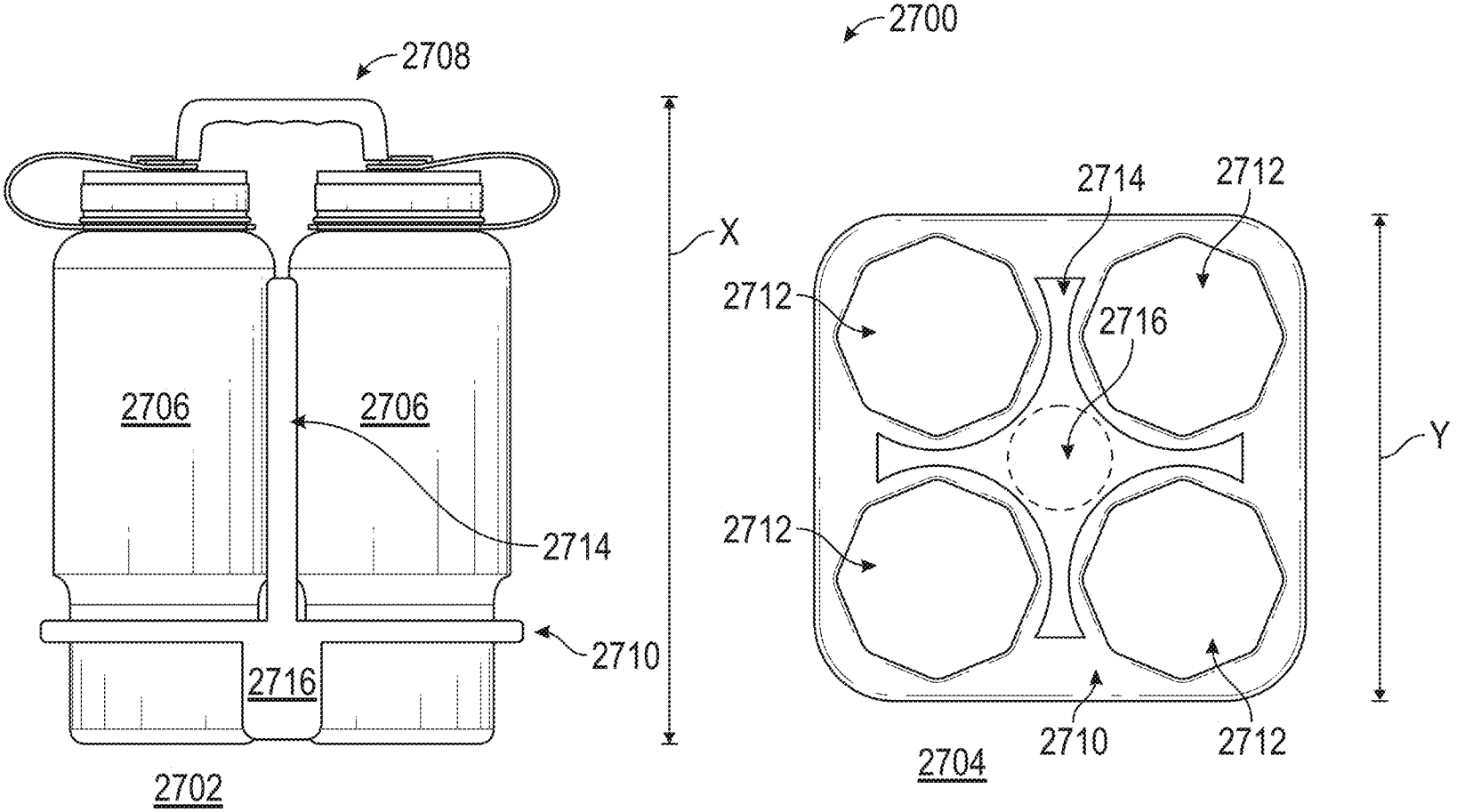
FIG. 27 illustrates a four-tumbler carrying component that incorporates teachings of the present disclosure.

Also depicted in FIG. 27 is a bumper wall 2714 extending up from platform 2710 and configured to provide some protection against the bumping of four installed tumblers against one another. In addition, a standing base leg 2716 may be included that extends down from platform 2710, which may protect against platform 2710 dropping beneath or to the bottom of installed tumblers when carrying component 2700 is set down. Though the depicted version of system 2700 has one central base leg 2716, other designers may elect to use more than one leg.

Figure 28:
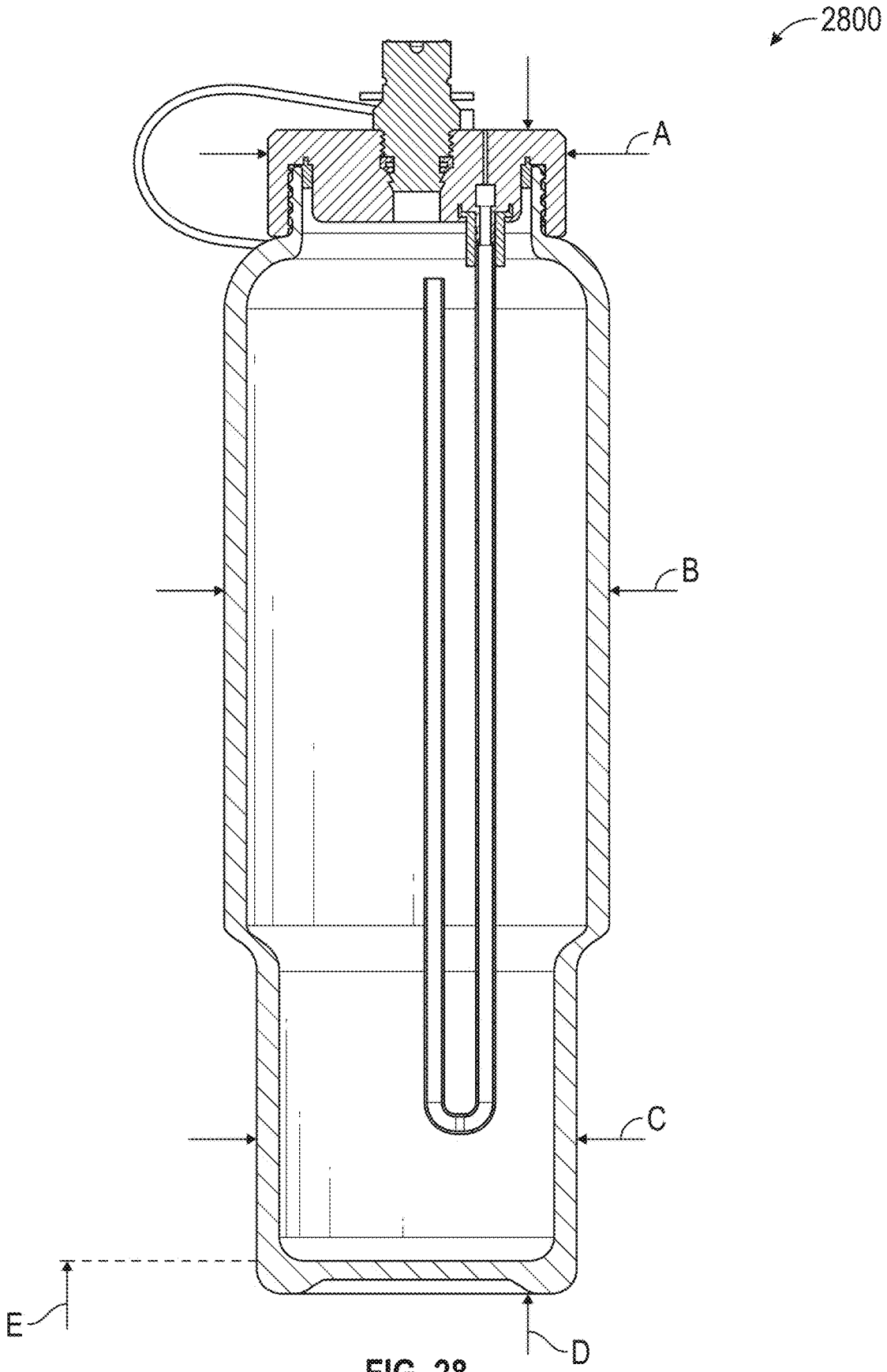
FIG. 28 illustrates a tumbler incorporating teachings of the present disclosure.

As mentioned above, FIG. 28 illustrates a tumbler 2800 incorporating teachings of the present disclosure. The depiction shows a cross section of tumbler 2800 and several example dimensions. As shown, tumbler 2800 has an internal capacity of approximately 40 oz. As mentioned above, other carry capacities could be chosen. For tumbler 2800, a mouth dimension "A" could be 2.25 to 2.35 inches. Other dimensions could be selected. Largest diameter dimension "B" could be 3.55 to 3.65 inches. Again, larger or smaller dimensions could be selected. Tapered dimension "C" could be 2.95 to 3.05 inches. Such a dimension could facilitate tumbler 2800 fitting into a vehicle cup holder, and again, the dimension could be smaller or larger. Cap on height "D" could be 10.85 to 10.95 inches, and taper height "E" could be 2.95 to 3.05 inches. Again, both of these height dimensions could be adjusted to be taller or shorter.

Figure 29:
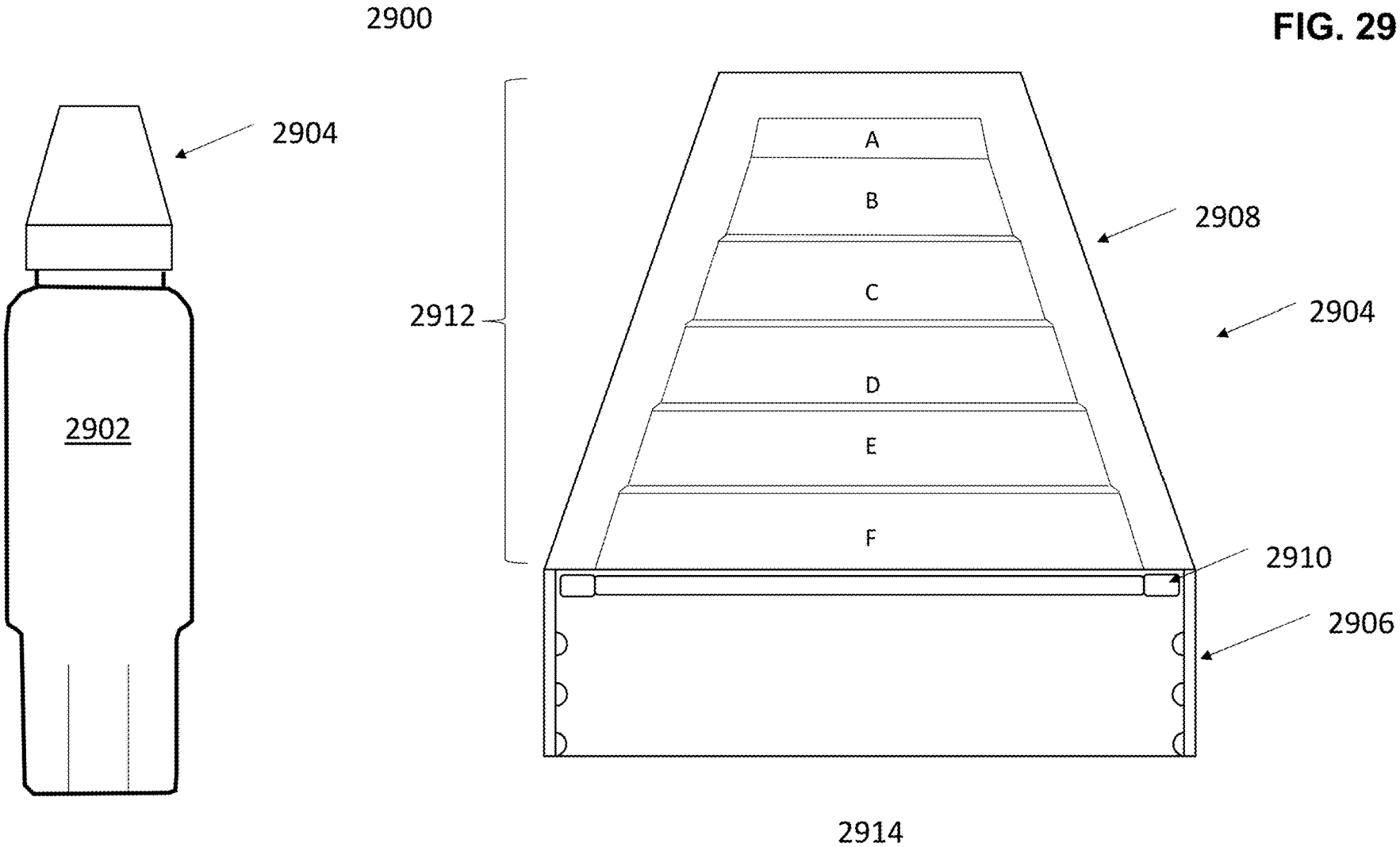
FIG. 29 illustrates a tumbler an measuring lead that incorporate teachings of the present disclosure.

As mentioned above, FIG. 29 illustrates a tumbler and measuring lid system 2900 that incorporates teachings of the present disclosure. As depicted, tumbler body 2902 may be an insulated, double-walled, stainless steel, tumbler body with a carrying capacity of approximately 40 oz. Threaded onto tumbler body 2902 may be several different types of lids, some of which were depicted in FIG. 19. In FIG. 29, lid 2904 is a measuring lid, which may be useful in preparing cocktails within tumbler body 2902, for example.

Depicted in view 2914 is a cross section view of lid 2904. As shown, lid 2904 has a threading portion 2906 and a measuring portion 2908. At the top of threading portion 2906 is a sealing gasket 2910. In practice, lid 2904 may be secured onto tumbler body 2902 such that seal 2910 is compressed and provides a water tight and removable coupling between tumbler body 2902 and lid 2904. This coupling may allow a user to vigorously shake and mix a cocktail within tumbler body 2902 without fear of any liquid spilling.

Also shown in FIG. 29, there is a measuring geometry 2912 within measuring portion 2908. As depicted measuring geometry 2912 has a stacked pyramid design with angled transitions between the pyramid layers. Among other things, this geometry may help in the manufacturing process, as the geometry 2912 may facilitate releasing from a mold. Also depicted within geometry 2912 are identifiers (labeled as A, B, C, D, E, and F). The identifiers may be stamped or otherwise included as a part of geometry 2912. In practice, these identifiers may be associated with different volumes of liquid that can be stored by that level of the pyramid. For example, if lid 2904 is inverted so that the measuring portion can hold liquid without spilling, a user may fill level A completely with a liquid. If level A represents 0.5 oz, the user knows that pouring the liquid from lid 2904 into tumbler body 2902 means they have added 0.5 oz of liquid to tumbler body 2902.

Each of the identifiers, which could be something other than letters, could represent a different volume. B could represent 1.5 oz, C could represent 3 oz, D could represent 4.5 oz, etc. The volume represented and the identifiers used could be changed as needed by a designer. Moreover, a designer could also provide a cocktail menu guide, for example, that listed components and quantities needed to make a given drink based on the identifiers used in lid 2904.

The benefits, advantages, solutions to problems, and any element(s) that may cause any benefit, advantage, or solution to occur or become more pronounced are not to be construed as a critical, required, or essential feature or element of the present invention. Accordingly, the present invention is not intended to be limited to the specific form set forth herein, but on the contrary, it is intended to cover such alternatives, modifications, and equivalents, as can be reasonably included within the spirit and scope of the invention as provided by the claims below.

While the present invention has been described with respect to a limited number of embodiments, those skilled in the art will appreciate numerous modifications and variations therefrom. It is intended that the appended claims should cover any such modifications and variations as fall within their true spirit and scope.

What is claimed is:

1. A system to hold a beverage, comprising:

a beverage container configured to be loaded within an internal silo of a cooler, the beverage container having a bottom surface, a rigid exterior surface, a resealable opening, and an interior volume of at least 750 ml but less than 3800 ml;

the resealable opening of the beverage container configured to facilitate adding a liquid into the interior volume, wherein the resealable opening comprises threads on the beverage container configured to allow a lid having threads to be secured to and removed from the beverage container; and the lid comprising an adapter plug configured to releasably connect to a mating plug to form a leak-proof coupling, the adapter plug having a spring-loaded stop valve that is opened when the adapter plug is releasably connected to the mating plug such that the liquid within the beverage container can gravity drain from the beverage container and through the opened spring-loaded stop valve when the beverage container is inverted.

2. The system of claim 1, further comprising a second lid having threads to be secured to and removed from the beverage container, wherein the second lid comprises a straw but does not have an adapter plug.

3. The system of claim 1, wherein the resealable opening is located at a top of the beverage container.

4. The system of claim 1, further comprising the cooler, the cooler having an enclosure portion, wherein the internal silo is located within the enclosure portion and the internal silo has a mating plug secured at the bottom of the internal silo.

5. The system of claim 4, wherein the cooler further comprises a second silo having its own mating plug secured at a bottom of the second silo.

6. The system of claim 4, further comprising a tube with a first end connected to a bottom of the mating plug and a second end connected to a spigot with a push-button flow control mechanism, wherein the mating plug is located within the enclosure portion and the push-button flow control mechanism is located outside the enclosure portion.

7. The system of claim 5, wherein the cooler further comprises:

a third silo having its own mating plug secured at a bottom of the third silo; and a fourth silo having its own mating plug secured at a bottom of the fourth silo.

8. A system to hold a beverage, comprising:

a tumbler configured to be loaded within an internal silo of a cooler, the tumbler having a bottom surface, a rigid exterior surface, a resealable opening, and an interior volume of at least 750 ml but less than 3800 ml;

the resealable opening of the tumbler configured to facilitate adding a liquid into the interior volume, wherein the resealable opening comprises threads on the tumbler configured to allow a lid having threads to be secured to and removed from the tumbler; and the lid comprising an adapter plug configured to releasably connect to a mating plug to form a leak-proof coupling, the adapter plug having a spring-loaded stop valve that is opened when the adapter plug is releasably connected to the mating plug such that the liquid within the tumbler can gravity drain from the tumbler and through the opened spring-loaded stop valve.

9. The system of claim 8, wherein the lid further comprises a flow channel formed through the adapter plug and the lid.

10. The system of claim 9, wherein the adapter plug further comprises the flow channel.

11. The system of claim 8, wherein the adapter plug is threadably adapted to the lid.

12. The system of claim 8, further comprising a breather tube to assist in relieving a vacuum condition within the tumbler.

13. The system of claim 12, wherein the lid further comprises a breathing port, the breather tube coupled to the breathing port.

14. The system of claim 8, wherein the bottom surface of the tumbler comprises a polygonal cross section.

15. The system of claim 8, further comprising a measuring lid to be threadably coupled to the tumbler.

16. The system of claim 15, wherein the measuring lid comprises a threading portion to threadably couple to the tumbler and a measuring portion having a measuring geometry to enable a plurality of different volumes of liquid to be held in the measuring lid.

17. A system to facilitate dispensing a beverage, comprising:

a lid configured to releasably attach to a container having an interior volume of at least 750 ml but less than 3800 ml; and an adapter plug incorporated into a portion of the lid, the adapter plug configured to releasably connect to a mating plug, the adapter plug having a spring-loaded stop valve that is opened when the adapter plug is releasably connected to the mating plug such that a liquid can pass through the opened spring-loaded stop valve when the container is inverted.

18. The system of claim 17, further comprising:

a breather tube to assist in relieving a vacuum condition within the container; and a breathing port, the breather tube coupled to the breathing port.

19. The system of claim 17, further comprising the container, wherein the container is a double wall insulated tumbler.

20. The system of claim 17, further comprising a tote with an enclosure portion, a silo located within the enclosure portion, and the silo including the mating plug secured at a bottom of the silo.

* * * * *